US006039775A

United States Patent [19]

Ho et al.

[11] Patent Number: 6,039,775

[45] Date of Patent: Mar. 21, 2000

[54] ABRASIVE ARTICLE CONTAINING A GRINDING AID AND METHOD OF MAKING THE SAME

[75] Inventors: Kwok-Lun Ho, Woodbury; Robert A. Follensbee, Cottage Grove; Walter L. Harmer, Arden Hills; Mary L. Morris, White Bear Lake, all of Minn.

[73] Assignee: 3M Innovative Properties Company, St. Paul, Minn.

[21] Appl. No.: 09/167,081

[22] Filed: Oct. 6, 1998

Related U.S. Application Data

[63] Continuation-in-part of application No. 08/962,622, Nov. 3, 1997, abandoned.

[51] Int. Cl.[7] ..... B23D 3/34

[52] U.S. Cl. ..... 51/295; 51/294; 51/298; 51/309

[58] Field of Search ..... 51/294, 295, 298, 51/309

[56] References Cited

U.S. PATENT DOCUMENTS

| | | |
|---|---|---|
| 2,216,135 | 10/1940 | Rainier . |
| 2,243,049 | 5/1941 | Kistler et al. . |
| 2,408,319 | 9/1946 | Kistler . |
| 2,690,385 | 9/1954 | Richlin . |
| 2,811,430 | 10/1957 | Gregor et al. . |
| 2,939,777 | 6/1960 | Gregor et al. . |
| 2,949,351 | 8/1960 | Vigliatura, Jr. . |
| 2,952,529 | 9/1960 | Stone . |
| 3,030,198 | 4/1962 | Kibbey . |
| 3,032,404 | 5/1962 | Douglass et al. . |
| 3,246,970 | 4/1966 | Zimmerman . |
| 3,502,453 | 3/1970 | Baratto . |
| 3,770,401 | 11/1973 | Sheets, Jr. et al. . |
| 4,420,532 | 12/1983 | Yamaguchi et al. . |
| 4,770,671 | 9/1988 | Monroe et al. . |
| 4,848,041 | 7/1989 | Kruschke . |
| 4,895,675 | 1/1990 | Smith . |
| 4,920,704 | 5/1990 | Caserta et al. . |
| 5,009,674 | 4/1991 | Kunz et al. . |
| 5,009,676 | 4/1991 | Rue et al. . |
| 5,011,512 | 4/1991 | Wald et al. . |
| 5,026,404 | 6/1991 | Kunz et al. . |
| 5,035,723 | 7/1991 | Kalinowski et al. . |
| 5,061,295 | 10/1991 | Hickory et al. . |
| 5,078,753 | 1/1992 | Broberg et al. . |
| 5,090,968 | 2/1992 | Pellow . |
| 5,096,983 | 3/1992 | Gerber . |
| 5,116,392 | 5/1992 | Selgrad et al. . |
| 5,201,916 | 4/1993 | Berg et al. . |
| 5,227,104 | 7/1993 | Bauer . |
| 5,366,523 | 11/1994 | Rowenhorst et al. . |
| 5,372,620 | 12/1994 | Rowse et al. . |
| 5,441,549 | 8/1995 | Helmin . |
| 5,672,185 | 9/1997 | Ryoke . |
| 5,725,162 | 3/1998 | Garg et al. . |
| 5,738,695 | 4/1998 | Harmer et al. . |
| 5,776,214 | 7/1998 | Wood . |
| 5,779,743 | 7/1998 | Wood . |

FOREIGN PATENT DOCUMENTS

| | | |
|---|---|---|
| 0 071 723 A3 | 2/1983 | European Pat. Off. . |
| 2657881 | 6/1978 | Germany . |
| 487287 | 6/1938 | United Kingdom . |
| 826729 | 10/1960 | United Kingdom . |
| 994484 | 6/1965 | United Kingdom . |
| WO 97/14535 | 4/1997 | WIPO . |

OTHER PUBLICATIONS

Kirk–Othmer Encyclopedia of Chemical Technology, 4$^{th}$ Edition, vol. 1, pp. 28–29 (1991) (no month).

Kirk–Othmer Encyclopedia of Chemical Technology, 3$^{rd}$ Edition, vol. 1, pp. 29–31 (1978) (no month).

I.S. Hong et al. "Coated Abrasive Machining of Titanium Allows with Inorganic Phosphate Solutions", Trans. ASLE, 14 (1971) pp. 8–11 (no month).

Cadwell et al, "Grinding a Titanium Ally with Coated Abrasive", ASME Paper 58–SA–44, Jun. 1958.

Patent Abstracts of Japan, vol. 12, No. 466, AN 88–261767 for Japanese Patent No. JP63191574, Aug. 9., 1988.

Patent Abstracts of Japan, vol. 17, No. 142, AN 92–418273 for Japanese Patent No. JP4311772 (published Nov. 4, 1992).

Patent Abstracts of Japan, vol. 13, No. 163, AN 89–051876 for Japanese Patent No. JP64002868 (published Jan. 6, 1989).

Derwent Abstract AN 77–80174Y for Japanese Patent No. 52115493 (published Sep. 28, 1977).
Derwent Abstract An 93–141620 for Patent No. SU 1731795 (published May 7, 1992).
Derwent Abstract AN 84–060147 for Japanese Patent No. 59 018782 A (published Jan. 31, 1984).
Derwent Abstract AN 86–118340 for Patent No. SU 1 186 634 A (published Oct. 23, 1985).

*Primary Examiner*—Michael Marcheschi
*Attorney, Agent, or Firm*—Scott R. Pribnow

[57] ABSTRACT

An abrasive article is provided which includes a peripheral surface formed comprising a grinding aid. The grinding aid is formed from a mixture including an acid and at least one of an inorganic metal phosphate salt or an inorganic metal sulfate salt. The acid is preferably selected so that the mixture forms a film. The abrasive article preferably has sharp abrasive particles. The inventive abrasive article improves grinding efficacy, particularly in titanium grinding processes, as compared to abrasive articles that are substantially devoid of a grinding aid of the present invention. Also provided is a method for making an abrasive article and a method of abrading a surface with an abrasive article.

74 Claims, 1 Drawing Sheet

ABRASIVE ARTICLE CONTAINING A GRINDING AID AND METHOD OF MAKING THE SAME

This is a continuation-in-part of application Ser. No. 08/962,622, filed Nov. 3, 1997 Abn.

BACKGROUND OF THE INVENTION

Abrasive articles, in general, include a plurality of abrasive particles and a binder. Examples of abrasive articles include bonded abrasive articles (such as grinding wheels), coated abrasive articles, nonwoven abrasive articles, to name a few. Coated abrasive products typically have a backing substrate, abrasive particles, and a binder system which operates to hold the abrasive particles to the backing. For example, in a typical coated abrasive product, the backing is first coated with a layer of binder, commonly referred to as a "make" coat, and then the abrasive particles are applied to the binder coating. As so applied, the abrasive particles optimally are at least partially embedded in the make coat. The resulting binder/abrasive particle layer is then generally solidified or set (such as by a series of drying or curing ovens) sufficient to retain the adhesion of abrasive particles to the backing. After precuring or setting the make coat, a second layer of binder, commonly referred to as a "size coat," is applied over the surface of the make coat and abrasive particles, and, upon setting, it further supports the particles and enhances the anchorage of the particles to the backing. Optionally, a "supersize" coat, which may contain grinding aids, can be applied over the precured size coat. In any event, once the size coat and supersize coat, if used, has been cured, the resulting coated abrasive product can be converted into a variety of convenient forms such as sheets, rolls, belts, and discs.

There exists a subclass of fillers, typically referred to as grinding aids. Grinding aids can be especially effective in abrading stainless steel, exotic metal alloys, titanium, metals slow to oxidize, and so forth. In some instances, a coated abrasive product containing a grinding aid in the binder can abrade significantly more stainless steel than a corresponding coated abrasive product in which the binder is devoid of a grinding aid. It is believed that one function of a grinding aid is to prevent metal capping by rapidly contaminating the freshly formed metal surface. Grinding aids are normally incorporated into the binder(s) of the abrasive article. Examples of common grinding aids include sodium aluminum hexafluoride (i.e., cryolite), sodium chloride, potassium tetrafluoroborate ($KBF_4$), iron pyrite, polyvinyl chloride, and polyvinylidene chloride.

Titanium alloys, in particular, such as those designed for aerospace applications and other applications where high strength to weight ratios are desirable, are extremely difficult to grind, even with coated abrasive articles including conventional grinding aids. Poor grinding efficiency of such materials may be alleviated somewhat by use of certain externally supplied grinding fluids, such as coolants or lubricants. These grinding aids typically flood the grinding interface between the abrasive article and the workpiece surface. Materials used as grinding aids or lubricants for titanium typically include soluble cutting oils such as highly chlorinated cutting oils. For example, I. S. Hong et al. describe solutions including inorganic tripotassium phosphate and an acid ($H_3PO_4$) or an acid salt ($NaH_2PO_4$) as a lubricant in titanium grinding with a coated abrasive article. Hong, I. S. et al., "Coated Abrasive Machining of Titanium Alloys With Inorganic Phosphate Solutions," Trans. ASLE, 14 (1971), pages 8–11. Other known lubricants typically include an inorganic salt, such as $NaNO_2$, $KNO_2$, $Na_3PO_4$, and $K_3PO_4$, as described by Cadwell et al., "Grinding a Titanium Alloy With Coated Abrasives," ASME Paper 58-SA-44, June, 1958. In International Publication No. WO 97/14535 Gagliardi et al., an abrasive article is described which contains tripotassium phosphate.

U.S. Pat. No. 4,770,671 (Monroe et al.) describes adding various types of grinding aids onto the surface of alpha-alumina-based ceramic abrasive grits in coated abrasive articles. In one example, Monroe et al. describe including $K_2HPO_4$ in a supersize coat of an amine-curable epoxy resin.

Attempts in the past have been directed toward new grinding aids to improve the efficiency of abrasive articles to abrade metal workpieces, such as titanium metal. Although these attempts have been somewhat successful, the industry continues to search for improvements in abrasive articles, the use of which results in a more efficient abrading of metal.

SUMMARY OF THE INVENTION

Abrasive articles of the present invention improve grinding efficacy, particularly in titanium grinding processes, as compared to abrasive articles that are substantially devoid of a grinding aid formed from a mixture including an acid and at least on of an inorganic metal phosphate salt or an inorganic metal sulfate salt. The grinding aid described herein has been found to work well in abrasive articles having sharp abrasive particles.

One aspect of the present invention relates to an abrasive article that includes a backing having a first major surface and a second major surface and a plurality of abrasive particles. In one preferred embodiment of the invention, an abrasive article includes a make coat formed from a first binder precursor, wherein the make coat bonds the plurality of abrasive particles to the first major surface of the backing. Also included in an abrasive article according to the invention is a peripheral coating layer including a grinding aid formed from a mixture containing an acid and at least one of an inorganic metal phosphate salt or an inorganic metal sulfate salt. Preferably, the inorganic metal phosphate salt is selected from the group of alkali metal phosphate salts and alkaline earth metal phosphate salts. Preferably, the inorganic metal sulfate salt is selected from the group of alkali metal sulfate salts, alkaline earth metal sulfate salts and a transition metal sulfate salts. It is preferred that the acid is selected such that the mixture forms a film.

In another preferred embodiment, the abrasive particles are sharp abrasive particles. As used herein, "sharp" refers to abrasive particles characterized by having thin edges and/or pointed ends. Sharp abrasive particles may be characterized by a low bulk density, high aspect ratio, and/or mean particle volume ratio ranging from about 0.3 to 0.8. Sharp abrasive particles are typically elongate in shape with a minimal number of rounded edges and ends. Sharp abrasive particles may also be in the form of thin platelets or flakes having sharp edges.

As used herein, the term "film" means a sheet, layer, or coating of a substance having a nominal thickness relative to its length and breadth, wherein the sheet, layer, or coating is substantially continuous in that there are no significant irregularities (e.g., defects, holes and the like) exposing the surface beneath the sheet, layer, or coating where it has been applied.

As used herein, "peripheral surface" refers to the outermost portion of an abrasive article that represents the portion for contacting and abrading a workpiece. In the context of coated abrasive articles, a "peripheral coating" or "peripheral coating layer" is the outermost surface of a coated abrasive article disposed on the working side of the coated abrasive article. The "working side" of the coated abrasive article is generally the side of the construction where the abrasive particles are adherently bonded to the backing, usually through a make coat. Thus, the peripheral coating is typically a size coat or a supersize coat, with the proviso that the coating in all cases represents the outermost portion of the abrasive article construction that is left uncoated by any other separate coating, whether it is derived from the same composition or a different composition.

As used herein, the term "phosphate(s)" means a salt containing phosphorus. Conventional nomenclature of several common anions of a phosphate included in the invention are orthophosphate ($PO_4^{3-}$), monohydrogen orthophosphate ($HPO_4^{2-}$), dihydrogen orthophosphate ($H_2PO_4^{1-}$), metaphosphate ($PO_3^{1-}$) and pyrophosphate ($P_2O_7^{4-}$), including monohydrogen pyrophosphate ($HP_2O_7^{3-}$), dihydrogen pyrophosphate ($H_2P_2O_7^{2-}$), and trihydrogen pyrophosphate ($H_3P_2O_7^{1-}$).

As used herein, the term "sulfate(s)" means a salt of sulfuric acid. Conventional nomenclature of several common anions of a sulfate included in the invention are sulfate ($SO_4^{2-}$) and monohydrogen sulfate ($HSO_4^{1-}$).

As used herein, the term "acid" means a substance that contains hydrogen and possesses the ability to react with certain metals to form salts and the ability to react with bases or alkalies to form salts. Acids may be categorized into several classes: inorganic acids, such as mineral acids including, but not limited to, sulfuric acid, nitric acid, hydrochloric acid and phosphoric acid; and organic acids, such as acetic acid, formic acid, benzoic acid, citric acid, lactic acid, oxalic acid, tartaric acid, and the like.

As used herein, the term "base" means any chemical species, ionic or molecular, capable of accepting or receiving a proton (hydrogen ion) from another substance, generally an acid. The greater the tendency to accept a proton, the stronger the base. As mentioned with respect to an acid, generally salts are formed upon the reaction (neutralization) of a base and an acid. Preferable bases include, sodium hydroxide, potassium hydroxide, lithium hydroxide, magnesium hydroxide, calcium hydroxide, barium hydroxide, and mixtures thereof.

Another aspect of the present invention provides an abrasive article including a backing having a first major surface and a second major surface; a plurality of abrasive particles; and a make coat formed from a first binder precursor, wherein the make coat bonds the plurality of abrasive particles, preferably sharp abrasive particles, to the first major surface of the backing. In this aspect of the present invention, a peripheral coating layer includes a grinding aid formed from a mixture containing an acid component, and a compound containing an alkali metal or an alkaline earth metal, with the provisos that:

(i) when the acid component consists essentially of an organic acid, the compound containing an alkali metal or an alkaline earth metal is a phosphate salt or a sulfate salt; and (ii) when the acid component consists essentially of a combination of an organic acid and a mineral acid, the compound containing an alkali metal or an alkaline earth metal is a base.

Preferably, the organic acid is selected from the group of citric acid, lactic acid, oxalic acid, tartaric acid, and mixtures thereof, whereas the mineral acid is preferably selected from the group of hydrochloric acid, nitric acid, sulfuric acid, phosphoric acid, tetrafluoroboric acid, and mixtures thereof.

In proviso (ii), the base of an alkali metal or an alkaline earth metal is preferably selected from the group of sodium hydroxide, potassium hydroxide, lithium hydroxide, magnesium hydroxide, calcium hydroxide, barium hydroxide, and mixtures thereof.

Abrasive articles of the present invention may further include a size coat formed from a second binder precursor, wherein the peripheral surface is on the size coat. Optionally, the peripheral surface is formed from the mixture further including a third binder. In either instance, the peripheral surface is referred to as a supersize coat.

Additionally, the mixture that forms a peripheral surface may further include an optional additive that may be selected from the group of a secondary grinding aid, a fibrous material, an antistatic agent, a lubricant, a wetting agent, a surfactant, a pigmnent, a dye, a coupling agent, a plasticizer, a release agent, a suspending agent, a rheology modifier, a curing agent, and mixtures thereof. A secondary grinding aid is preferably selected from the group of sodium chloride, potassium aluminum hexafluoride, sodium aluminum hexafluoride, ammonium aluminum hexafluoride, potassium tetrafluoroborate, sodium tetrafluoroborate, silicon fluorides, potassium chloride, magnesium chloride, and mixtures thereof.

A further aspect of the present invention provides an abrasive article including at least one binder formed from a composition comprising a binder precursor and a grinding aid. The grinding aid is formed from a mixture containing an acid and at least one of a phosphate salt or a sulfate salt. A plurality of abrasive particles, preferably sharp abrasive particles, are dispersed within the binder to form a plurality of shaped composites having a peripheral surface capable of contacting a workpiece surface.

Preferably, the inorganic metal phosphate salt is selected from the group of alkali metal phosphate salts and an alkaline earth metal phosphate salts. Preferably, the inorganic metal phosphate salt is selected from the group of tripotassium orthophosphate, trisodium orthophosphate, tricalcium orthophosphate, sodium pyrophosphate, potassium pyrophosphate and mixtures thereof. The inorganic metal sulfate salt is selected from the group of alkali metal sulfate salts, alkaline earth metal sulfate salts and a transition metal sulfate salts. Preferably, the inorganic metal sulfate salt is selected from the group of sodium sulfate, potassium sulfate, cesium sulfate, copper(II) sulfate, iron(II) sulfate, manganese(II) sulfate, cobalt(II) sulfate and mixtures thereof.

The acid preferably is an organic acid, and more preferably the acid is an organic acid selected from the group of citric acid, lactic acid, oxalic acid, tartaric acid, and mixtures thereof.

Yet another aspect of the present invention provides an abrasive article including at least one binder formed from a composition comprising a binder precursor and a grinding aid formed from a mixture including an acid component and a compound containing an alkali metal or an alkaline earth metal, with the provisos that:

(i) when the acid component consists essentially of an organic acid, the compound containing an alkali metal or an alkaline earth metal is a phosphate salt or a sulfate salt; and (ii) when the acid component consists essentially of a combination of an organic acid and a mineral acid, the compound containing an alkali metal or an alkaline earth metal is a base.

The abrasive article also includes a plurality of abrasive particles, preferably sharp abrasive particles, dispersed within at least one binder to form a shaped mass having a peripheral surface capable of contacting a workpiece surface. Preferably, the shaped mass is a grinding wheel.

In abrasive articles according to the invention, such as those described above, a binder precursor used to form the make, size and/or supersize coats or to disperse a plurality of abrasive particles are each selected from the group of a phenolic resin, an aminoplast resin having pendant α,β-unsaturated carbonyl groups, a urethane resin, an epoxy resin, an ethylenically unsaturated resin, an acrylated isocyanurate resin, a urea-formaldehyde resin, an isocyanurate resin, an acrylated urethane resin, an acrylated epoxy resin, a bismaleimide resin, a fluorene modified epoxy resin, and mixtures thereof.

Another aspect of the invention provides a method for making a coated abrasive article, including the steps of applying a first binder precursor to a substrate; at least partially embedding a plurality of abrasive particles, preferably sharp abrasive particles, in the first binder precursor; applying a second binder precursor over the first binder precursor and the plurality of abrasive particles; applying a peripheral coating mixture on the second binder precursor, wherein the peripheral coating mixture comprises an acid and at least on of an inorganic metal phosphate salt or an inorganic metal sulfate salt; and at least partially curing the first binder precursor and the second binder precursor. Preferably, the peripheral coating mixture forms a film. All constructions containing partially cured binder precursors typically require an eventual final cure.

Additionally, another aspect of the present invention is a method of using an abrasive article to grind a workpiece surface including the steps of frictionally engaging an abrasive article with an outer surface of a workpiece. Preferably, the abrasive article includes a backing having a first major surface and a second major surface; a plurality of abrasive particles; a make coat formed from a first binder precursor, wherein the make coat bonds the plurality of abrasive particles, preferably sharp abrasive particles, to the first major surface of the backing; a size coat formed from a second binder precursor, wherein the size coat is on a surface of the plurality of abrasive particles and the make coat. Also included is a peripheral coating layer including a grinding aid formed from a mixture comprising an acid and at least one of an inorganic metal phosphate salt or an inorganic metal sulfate salt, wherein the peripheral surface on the size coat and is frictionally engaged with the surface of the workpiece. The method also includes moving the abrasive article and the workpiece relative to each other such that the surface of the workpiece is reduced.

BRIEF DESCRIPTION OF THE SEVERAL VIEWS OF THE DRAWING

Other features, advantages, and methods of practicing the invention will be better understood from the following figures and the preferred embodiments of the present invention.

DESCRIPTION OF PREFERRED EMBODIMENTS

Abrasive Articles

In general, abrasive articles in accordance with the invention include a plurality of abrasive particles and at least one bond or binder system formed from a composition including a binder precursor, and a peripheral surface comprising a grinding aid. Preferably, the grinding aid formed from a mixture comprising an acid and at least one of an inorganic metal phosphate salt or an inorganic metal sulfate salt. Preferably, the acid is selected such that the mixture forms a film.

Preferably, an inorganic metal phosphate salt is selected from the group of alkali metal or alkaline earth metal phosphate salts and more preferably, the inorganic metal phosphate salt is selected from the group of tripotassium orthophosphate, trisodium orthophosphate, tricalcium orthophosphate, sodium pyrophosphate, potassium pyrophosphate and mixtures thereof.

Preferably, an inorganic metal sulfate salt is selected from the group of alkali metal, alkaline earth metal and transition metal sulfate salts. More preferably, the inorganic metal sulfate salt is selected from the group of sodium sulfate, potassium sulfate, cesium sulfate, copper(II) sulfate, iron(II) sulfate, manganese(II) sulfate, cobalt(II) sulfate and mixtures thereof.

Examples of abrasive articles include coated abrasive articles, structured abrasive articles, lapping coated abrasive articles, nonwoven abrasive articles, and bonded abrasive articles.

Preferably, the acid is an organic acid and more preferably, the acid is an organic acid selected from the group of citric acid, lactic acid, oxalic acid, tartaric acid, and mixtures thereof.

Coated Abrasive Articles

Coated abrasive articles of the invention include a backing having a first major surface and a second major surface; a plurality of abrasive particles; a make coat bond system formed from a first binder precursor, wherein the make coat bond system bonds the plurality of abrasive particles to the first major surface of the backing; and a peripheral coating comprising a grinding aid. Typically, the abrasive article may exhibit a 15% increase or more in an amount of surface abraded away in a Titanium Grinding Test, as described herein, when compared to an abrasive article substantially free of a grinding aid of the invention.

Figure 1:
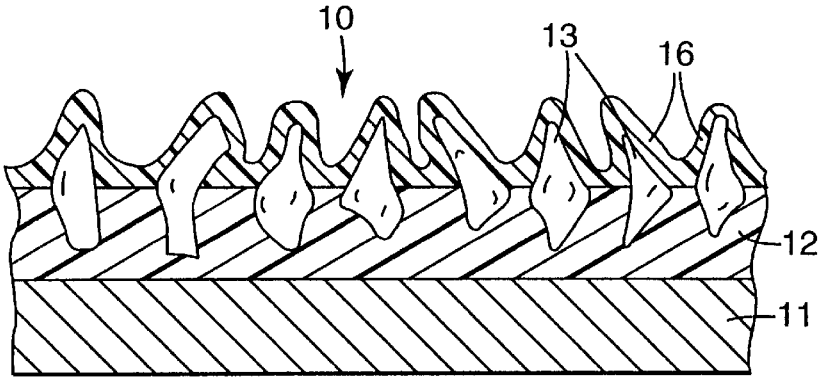
FIGS. 1–3 are cross-sectional views of various embodiments of abrasive articles in accordance with the invention.
Figure 2:
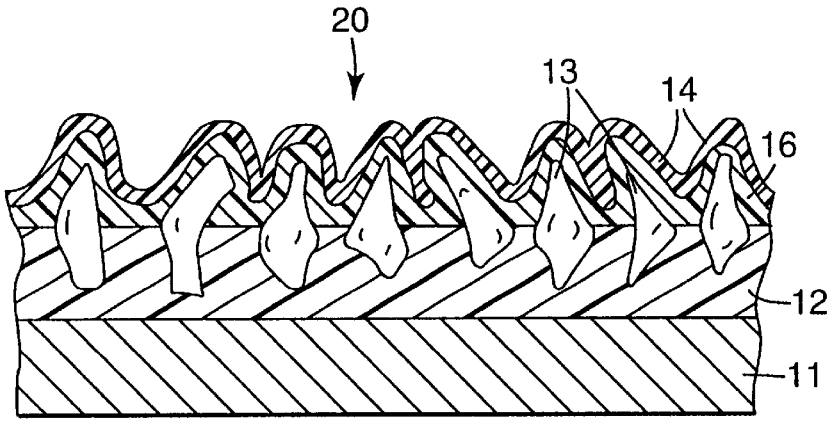

With reference to FIG. 1, a coated abrasive article 10 in accordance with the present invention may include a first binder 12 (commonly referred to as a make coat) bonded to one side (a major surface) of the backing 11, a plurality of abrasive particles 13 bonded to the backing by the make coat 12, and a size coat 16. The size coat 16 can be formed from a mixture including at least one inorganic metal phosphate or sulfate salt, an acid, and a second binder precursor. Preferably, the size coat 16 is formed on and in between the plurality of abrasive particles, thus forming a peripheral coating having a peripheral surface on the abrasive article. With reference to FIG. 2, a coated abrasive article 20 of the present invention may include a make coat 12, a backing 11, a plurality of abrasive particles 13, and a size coat 16, and a supersize coat 14 over at least a portion of the size coat 16. In this embodiment, the supersize coat 14 is a grinding aid formed from a mixture including an acid and at least one of an inorganic metal phosphate salt or an inorganic metal sulfate salt. Optionally, a third binder precursor may be included. Preferably, the supersize coat 14 is formed on at least a portion of size coat 16, thus forming a peripheral coating having a peripheral surface on the abrasive article.

Coated abrasives of the present invention also include lapping abrasive articles. A lapping coated abrasive article comprises a backing having an abrasive coating bonded to the backing. The abrasive coating comprises a plurality of abrasive particles distributed in a binder. In some instances, the binder bonds this abrasive coating to the backing. Alternatively, an additional material may be used to bond the abrasive coating to the backing, which may be selected, for example, from the binder precursors described herein and may be the same or different than the binder precursor used to form the abrasive coating. Generally, the particle size of the abrasive particles used in a lapping coated abrasive ranges, on average, less than about 200 micrometers, typically, 0.1 to 120 micrometers. The abrasive coating may have a smooth outer surface or a textured outer surface. The abrasive coating may also further comprise additives as discussed herein.

Structured Abrasive Articles

Structured abrasive articles typically include a plurality of precisely shaped abrasive composites bonded to a backing. These abrasive composites include a plurality of abrasive particles dispersed in a binder formed from a binder precursor and a grinding aid composition of the invention. U.S. Pat. No. 5,152,917 (Pieper et al.) generally describes structured abrasive articles. The grinding aid, formed from a mixture including an acid and at least one inorganic metal phosphate or sulfate salt, is present in a part of the structured abrasive article which will ultimately contact a workpiece during abrading, for example, in a peripheral portion of the structured abrasive article. For example, the grinding aid can be present in a peripheral coating over at least a portion of the precisely shaped composites. Alternatively, the grinding aid may be included in the binder so that the grinding aid is present within the abrasive composites.

Nonwoven Abrasive Articles

Figure 3:
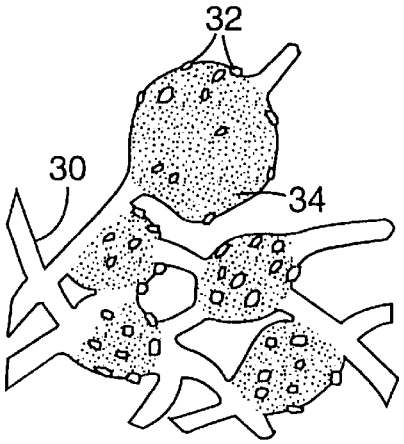

Nonwoven abrasive articles are also within the scope of the invention and include an open, lofty fibrous substrate having a binder which binds fibers at points where they contact. Optionally, abrasive particles or nonabrasive particles (such as fillers) may be adhered to the fibers by the binder if the manufacturer desires. For example, with reference to FIG. 3, a nonwoven abrasive comprises an open, lofty, fibrous substrate comprising fibers 30 and a binder 34 which bonds a plurality of abrasive particles 32 to the fibers.

Nonwoven abrasives are described generally in U.S. Pat. No. 2,958,593 (Hoover et al.) and U.S. Pat. No. 4,991,362 (Heyer et al.). In the present invention, a grinding aid, formed from a mixture including an acid and at least one inorganic metal phosphate or sulfate salt, is present in a part of the abrasive article which will ultimately contact a workpiece during abrading, for example, in a peripheral portion of the nonwoven abrasive article, for example, in a binder or in a peripheral coating over at least a portion of the binder.

Bonded Abrasive Articles

Bonded abrasive articles are also in the scope of the invention. These abrasive articles typically include a plurality of abrasive particles secured within a binder. Bonded abrasive articles are generally described in U.S. Pat. No. 4,800,685 (Haynes). Typically, the binder and the plurality of abrasive particles together form a shaped mass. Typically, this shaped mass is in the form of a wheel, generally referred to as a "grinding wheel," for example. In accordance with the invention, a grinding aid, formed from a mixture including an acid and at least one inorganic metal phosphate salt or sulfate salt, is present in a part of the abrasive article which will ultimately contact a surface of a workpiece during abrading. Preferably, the grinding aid is in a peripheral surface of the bonded abrasive article. For example, the grinding aid may be present in a binder formed from a first binder precursor and the grinding aid or in a peripheral coating formed from a second binder precursor and the grinding aid.

The Backing

The backing used as a substrate for abrasive articles of this invention generally will be made of a sheet or film of a material that is compatible with the make coat or abrasive slurry coat and other elements or components of the abrasive product. Further, the backing should be capable of maintaining its integrity during fabrication and use of the abrasive product. Examples of backing materials are paper, fiber, polymeric film, woven and nonwoven fabric or cloth. The backing may also contain a treatment or treatments to seal the backing, for example, to make them waterproof, and modify physical properties thereof. Still other examples of useful backings include U.S. Pat. Nos. 5,316,812 and 5,573,619. Also, reference is made to U.S. Pat. No. 5,011,512 describing specific, woven, polyester cloth backings of certain weights and saturated with a calcium carbonate-filled latex/phenolic resin coating (useful also as a backsize treatment). The backing may also have an attachment means on its back surface to secure the resulting coated abrasive to a support pad or back-up pad. This attachment means can be a pressure sensitive adhesive or a fabric for a hook and loop attachment.

The Binder

Binders suitable for an abrasive article of the present invention are formed from a binder precursor. It is within the scope of the present invention to use a water-soluble binder precursor or water-dispersible binder precursor. Preferably, a suitable binder comprises a cured or solidified binder precursor and serves to adhere a plurality of abrasive particles to a substrate (i.e., a backing for a coated abrasive or a nonwoven for a nonwoven abrasive). The binder included in the make coat, size coat and the supersize coat may be formed from the same binder precursor or each may be formed from a different binder precursor.

The term "binder precursor" as used herein refers to an uncured or a flowable material. The binder precursor is preferably a thermosetting resin. As used herein, "thermosetting" or "thermoset" refers to a reactive system that irreversibly cures upon application of heat and/or other energy sources, such as E-beam, ultraviolet radiation, visible light, etc., or with time upon the addition of a chemical catalyst, moisture, or the like. The term "reactive" means that the components of the binder precursor react with each other (or self reacts) either by polymerizing, crosslinking, or both. These components are often referred to as resins. As used herein, "resin" refers to polydisperse systems containing monomers, oligomers, polymers, or combinations thereof.

More preferably, the binder precursor is selected from the group of a phenolic resin, an aminoplast resin having pendant $\alpha,\beta$-unsaturated carbonyl groups, a urethane resin, an epoxy resin, a urea-formaldehyde resin, an isocyanurate resin, a melamine-formaldehyde resin, an acrylate resin, an acrylated isocyanurate resin, an acrylated urethane resin, an acrylated epoxy resin, a bismaleimide resin, and mixtures thereof.

Phenolic resins are commonly used as abrasive article binder precursors because of their thermal properties, availability, cost and ease of handling. There are two types of phenolic resins, resole and novolac. Resole phenolic resins have a molar ratio of formaldehyde to phenol, of greater than or equal to one to one, typically between 1.5:1.0 to 3.0:1.0. Novolac resins have a molar ratio of formaldehyde to phenol, of less than one to one.

The phenolic resin preferably includes about 70% to about 85% solids, and more preferably about 72% to about 82% solids. If the percent solids is very low, then more energy is required to remove the water and/or solvent. If the percent solids is very high, then the viscosity of the resulting phenolic resin is too high which leads to processing problems. The remainder of the phenolic resin is preferably water with substantially no organic solvent due to environmental concerns with the manufacturing of abrasive articles.

Examples of commercially available phenolic resins include those known under the trade designations "VARCUM" and "DUREZ" from Occidental Chemical Corp., Tonawanda, N.Y.; "AROFENE" and "AROTAP" from Ashland Chemical Company, Columbus, Ohio; "RESINOX" from Monsanto, St. Louis, Mo.; and "BAKELITE" from Union Carbide, Danbury, Conn.

It is also within the scope of the present invention to modify the physical properties of a phenolic resin. For example, a plasticizer, latex resin, or reactive diluent may be added to a phenolic resin to modify flexibility and/or hardness of the cured phenolic binder.

A suitable aminoplast resin for use in a binder precursor is one having at least one pendant α,β-unsaturated carbonyl groups per molecule. These unsaturated carbonyl groups can be acrylate, methacrylate or acrylamide type groups. Examples of such materials include N-hydroxymethylacrylamide, N,N'-oxydimethylenebisacrylamide, ortho and para acrylamidomethylated phenol, acrylamidomethylated phenolic novolac and combinations thereof.

Epoxy resins utilized in a binder precursor have an oxirane ring and are polymerized by ring opening. Such epoxide resins include monomeric epoxy resins and polymeric epoxy resins. These resins can vary greatly in the nature of their backbones and substituent groups. Examples of epoxy resins include 2,2-bis[4-(2,3-epoxypropoxyphenol)propane (diglycidyl ether of bisphenol A)] and commercially available materials under the trade designations, "EPON 828," "EPON 1004," and "EPON 1001F," available from Shell Chemical Co., Houston, Tex.; "DER-331," "DER-332," and "DER-334," all available from Dow Chemical Co., Midland, Mich. Other suitable epoxy resins include glycidyl ethers of phenol formaldehyde novolac (e.g., "DEN-431" and "DEN-438" available from Dow Chemical Co., Midland, Mich.). Other epoxy resins include those described in U.S. Pat. No. 4,751,138 (Tumey et al.).

Examples of useful binder precursors include a waterborne acrylic polymer or copolymer, commercially available under the trade designation NEOCRYL; a urethane-acrylic copolymer dispersion, commercially available under the trade designation NEOPAC; a polyurethane dispersion, commercially available under the trade designation NEOREZ, all available from Zeneca Division of ICI America, Wilmington, Mass.; and acrylic and acrylonitrile latexes, commercially available under the trade designation HYCAR, available from B.F. Goodrich, Cleveland, Ohio. These dispersions generally form films by water removal. However, other suitable dispersions will form films by a combination of water removal and curing by exposure to thermal energy, or radiation energy, such as UV radiation. Examples include acrylated acrylic or acrylated urethane polymer emulsions, commercially available under the trade designation NEORAD, available from Zeneca Division of ICI America, Wilmington, Mass.; and an acrylated polyester, commercially available under the trade designation IRR-114, available from UCB Chemical Corp., Atlanta, Ga.

Other examples of suitable polymeric dispersions include a 100% solids blend of vinyl ether monomers and oligomers. Such blends are typically low molecular weight materials which form films by crosslinking upon exposure to UV radiation. Examples of commercially available blends include RAPICURE from ISP, Wayne, N.J.; and VECTOMER from Allied Signal, Morristown, N.J. A catalyst is typically required to initiate crosslinking. A suitable catalyst such as UVI-6990 (a cationic photocatalyst) from Union Carbide, Danbury, Conn., can be used.

Urea-aldehyde resins employed in binder precursor compositions comprise urea or any urea derivative and any aldehyde which are capable of being rendered coatable, have the capability of reacting together at an accelerated rate in the presence of a catalyst, preferably a cocatalyst, and which afford an abrasive article with abrading performance acceptable for the intended use. The resins comprise the reaction product of an aldehyde and a urea.

Acrylate resins that can be included in a binder precursor include both monomeric and polymeric compounds that contain atoms of carbon, hydrogen and oxygen, and optionally, nitrogen and the halogens. Oxygen or nitrogen atoms or both are generally present in ether, ester, urethane, amide, and urea groups. Representative examples of acrylate resins include methyl acrylate, ethyl acrylate, methyl methacrylate, ethyl methacrylate, ethylene glycol diacrylate, ethylene glycol dimethacrylate, hexanediol diacrylate, triethylene glycol diacrylate, trimethylolpropane triacrylate, glycerol triacrylate, pentaerythritol triacrylate, pentaerythritol trimethacrylate, pentaerythritol tetraacrylate and pentaerythritol tetramethacrylate, as well as these unsaturated monomers, for example, styrene, divinylbenzene, vinyl toluene.

A hot melt resin may also be included in a binder precursor. For example, a binder precursor system may comprise a hot melt pressure sensitive adhesive which can be energy cured to provide a binder. In this instance, the binder precursor is a hot melt composition which may exhibit some process advantages. Exemplary hot melt resins are described in U.S. Pat. No. 5,436,063 (Follett et al.).

Abrasive Particles

Abrasive particles useful in the invention can be of any conventional type or grade (i.e., particle size) utilized in the formation of abrasive articles. The abrasive particles typically have a particle size ranging from about 1500 micrometers or less, usually between about 0.1 to 800 micrometers. It is preferred that the abrasive particles have a Mohs' hardness of at least about 8, more preferably above 9.

Examples of conventional abrasive particles include fused aluminum oxide (which includes brown aluminum oxide, heat treated aluminum oxide, and white aluminum oxide), sintered aluminum oxide, green silicon carbide, silicon carbide, chromia, alumina zirconia, diamond, iron oxide, ceria, cubic boron nitride, boron carbide, garnet, and a combination thereof.

Sintered alumina abrasive particles can be made according to a sol gel process or based upon sintered alumina powders. Additional details concerning sol gel abrasive particles are reported in U.S. Pat. No. 4,314,827 (Leitheiser et al.), U.S. Pat. No. 4,518,397 (Leitheiser et al.), U.S. Pat. No. 4,623,364 (Cottringer et al.), U.S. Pat. No. 4,744,802 (Schwabel), U.S. Pat. No. 4,770,671 (Monroe et al.), U.S. Pat. No. 4,881,951 (Wood et al.), U.S. Pat. No. 5,011,508 (Wald et al.), U.S. Pat. No. 5,090,968 (Pellow), U.S. Pat. No.

5,139,978 (Wood), U.S. Pat. No. 5,201,916 (Berg et al.), U.S. Pat. No. 5,227,104 (Bauer), U.S. Pat. No. 5,366,523 (Rowenhorst et al.), U.S. Pat. No. 5,429,647 (Larmie), U.S. Pat. No. 5,498,269 (Larmie), U.S. Pat. No. 5,547,479 (Conwell et al.), U.S. Pat. No. 5,551,963 (Larmie), U.S. Pat. No. 5,725,162 (Garg et al) and U.S. Pat. No. 5,776,214 (Wood). Additional details concerning sintered alumina abrasive particles made by using alumina powders as a raw material source are reported in U.S. Pat. No. 5,259,147 (Falz); U.S. Pat. No. 5,593,467 (Monroe) and U.S. Pat. No. 5,665,127 (Moltgen). Examples of fused alumina zirconia abrasive particles include those disclosed in U.S. Pat. Nos. 3,781,408 and 3,893,826.

It is also within the scope of the present invention to coat the abrasive particles with a surface coating. Surface coatings are reported in U.S. Pat. No. 1,910,440 (Nicholson), U.S. Pat. No. 3,041,156 (Rowse), U.S. Pat. No. 5,009,675 (Kunz et al.), U.S. Pat. No. 4,997,461 (Markhoff-Matheny et al.), and U.S. Pat. No. 5,042,991 (Kunz et al.), U.S. Pat. No. 5,011,508 (Wald et al.), and U.S. Pat. No. 5,213,591 (Celikkaya et al.).

Suitable abrasive particles may also include abrasive particles which have been mixed or agglomerated with each other, or with diluent particles. The particle size of these diluent particles preferably is on the same order of magnitude as the abrasive particles. Examples of such diluent particles include gypsum, marble, limestone, flint, silica grinding aids, glass bubbles, glass beads, aluminum silicate, and the like.

Preferred abrasive particles useful in the present invention can be described as being "sharp." In general, sharp abrasive particles are elongate in shape. Another way to describe a sharp abrasive particle is a particle that is in the form of a sliver or shard. Preferably, sharp abrasive particles have "pointy" ends (i.e., the faces forming the ends of the abrasive particle meet at a point) and angular faces. Sharp abrasive particles may also be in the form of thin platelets or flakes having sharp edges. Sharp abrasive particles should have a minimal number of rounded edges or ends. Sharp abrasive particles do not have a round or a blocky shape.

Sharp abrasive particles useful in the present invention may be irregularly shaped (i.e., randomly shaped) or may have a particular shape, such as a rod, cone, triangle or the like. It is preferred that the abrasive particles are randomly shaped (i.e., they do not have a predetermined shape).

There are several techniques useful for measuring the sharpness of an abrasive particle or sample of abrasive particles. These techniques include bulk density, aspect ratio and mean particle volume ratio. The bulk density of a sample of abrasive particles can be measured using the procedure described in ANSI Standard B74.4-1992, incorporated herein by reference. In general, the bulk density is measured by pouring the abrasive particles through a funnel such that the abrasive particles traverse through the funnel in a free flowing manner. Immediately underneath the funnel is a collection device, for example, a graduated cylinder. A predetermined volume of abrasive particles is collected and weighed. The bulk density is calculated by dividing the weight of the abrasive particles by the volume of the abrasive particles. Generally, a sample of sharp abrasive particles will have a lower bulk density than a sample of blocky abrasive particles.

The bulk density also depends upon the particular grade (i.e. particle size distribution) of the abrasive particles. In general, a coarser (i.e., larger particle size distribution) sample of abrasive particles will have a higher bulk density value. Conversely, a finer (i.e., smaller particle size distribution) sample of abrasive particles will generally have a lower bulk density value.

For grade 36 abrasive particles (grade measured by ANSI standard B74.12-1992) the bulk density for the sharp abrasive particles should be less than about 1.85 grams/cm$^3$, preferably less than about 1.83 grams/cm$^3$, more preferably less than about 1.81 grams/cm$^3$, still more preferably less than about 1.79 grams/cm$^3$, and most preferably less than about 1.77 grams/cm$^3$. In some instances for grade 36, the bulk density may be less than 1.66 grams/cm$^3$ or less than 1.64 grams/cm$^3$. For grade 50 abrasive particles (grade measured by ANSI standard B74.12-1992) the bulk density for the sharp abrasive particles should be less than about 1.79 grams/cm$^3$, preferably less than about 1.75 grams/cm$^3$, more preferably less than about 1.73 grams/cm$^3$, still more preferably less than about 1.71 grams/cm$^3$, and most preferably less than about 1.69 grams/cm$^3$.

Another technique for measuring the sharpness of abrasive particles is to determine their aspect ratio. The aspect ratio of an abrasive particle is defined as its length divided by its cross sectional width. Typically, sharp abrasive particles have an aspect ratio of at least 1:1, preferably at least about 1.5:1, and more preferably at least about 2:1. In some instances, the aspect ratio may be greater than 3:1.

Yet another technique for measuring sharpness is to determine the mean particle volume ratio for a sample of abrasive particles. For sharp abrasive particles, the mean particle volume ratio is typically less than about 0.80, preferably ranging from about 30 to 0.80, and more preferably ranging from about 0.30 to 0.70. The mean particle volume ratio for a sample of abrasive particles may be determined according to the following procedure:

(1) Mean particle weight is calculated by weighing a random sample of abrasive particles, counting the number of individual particles in the sample (preferably using an electronic particle analyzer), and dividing the weight by the number of particles to obtain a mean particle weight.

(2) The density of the sample is measured by a gas pycnometer.

(3) The mean particle weight is then divided by the density of the sample to obtain the mean particle volume.

(4) The mean particle volume ratio can be calculated by dividing the mean particle volume of the sample (i.e., the value calculated in step 3) by the volume of a standard sand for the same grade. The following table indicates the weight/particle and volume/particle for standard sands (ANSI Standard B74.18-1984).

| Grade | Weight/particle ($g \times 10^{-6}$) | Volume/particle ($cc \times 10^{-6}$) |
|---|---|---|
| 20 | 1524 | 397 |
| 24 | 918 | 239 |
| 30 | 610 | 159 |
| 36 | 342 | 89 |
| 40 | 209 | 54 |
| 50 | 90 | 23 |
| 60 | 42 | 10.9 |
| 80 | 11.2 | 2.9 |
| 100 | 4.9 | 1.3 |
| 120 | 2.4 | 0.63 |

-continued

| Grade | Weight/particle ($g \times 10^{-6}$) | Volume/particle ($cc \times 10^{-6}$) |
|---|---|---|
| 150 | 1.6 | 0.42 |

Additional details concerning mean particle volume ratio are reported in U.S. Pat. No. 4,848,041 (Kruschke).

There are several known methods for producing sharp abrasive particles. A first method is to crush larger sized abrasive particles to produce the desired particle size and particle size distribution. Examples of common crushing techniques include roll crushing, jaw crushing, hammer mill crushing and the like. During crushing, conditions should be set such that the desired bulk density, mean particle volume ratio and/or aspect ratio is achieved. For example, the rotational speed and/or the pressure applied can alter the bulk density and particle size of the abrasive particles being crushed.

Another technique to produce sharp abrasive particles is to physically separate the blockier abrasive particles from the sharp abrasive particles until the desired bulk density, mean particle volume ratio and/or aspect ratio is achieved. This physical separation can be accomplished by a variety of techniques. One technique is to vibrate the abrasive particles along a table (e.g., a Jeffrey Vibrating Shape Sorting Table (Model 2DTH) from Jeffrey Mfg. Co., Ltd., Johannesburg, South Africa) that is set at an angle. The sharper abrasive particles will tend to traverse more, whereas the blockier abrasive particles will tend to traverse less. Separate receptacles are positioned to collect the sharp abrasive particles and the blocky abrasive particles.

In another technique, a sample of abrasive particles is prepared such that all of the individual abrasive particles have essentially the same particle size. This may be accomplished, for example, by conventional screening techniques. Then, the abrasive particles are vibrated in a rotap screener. The blockier abrasive particles will tend to settle to the bottom of the rotap screener collection device, whereas the sharper abrasive particles will tend to settle to the top of the rotap screener collection device.

A particularly preferred sharp abrasive particle is a sharp alumina abrasive particle, preferably made by a sol gel process. The first step to make sharp sol gel abrasive particles is to prepare an alumina based dispersion. The alumina dispersion comprises an alumina source (e.g., $\alpha$-alumina or alumina precursor), optional acid and water. A metal oxide precursor and/or nucleating agent may also be included in the alumina based dispersion.

An alpha alumina precursor is a material that is capable of converting to alpha alumina upon the appropriate sintering conditions. The preferred alpha alumina precursor is alpha alumina monohydrate, commonly referred to as boehmite. Suitable boehmite is commercially available from Condea Chemie, GmbH of Hamburg, Germany under the trade designation "DISPERAL" and from Alcoa Company under the trade designation "Hi-Q" boehmite. Preferably, the boehmite has an average ultimate particle size of less than about 20 nanometers (more preferably, less than about 12 nanometers), wherein "particle size" is defined by the longest dimension of a particle.

The alumina based dispersion further comprises water. The water may be tap water, distilled water or deionized water. The water may be heated to cause increased dispersibility of the boehmite in water.

The alumina based dispersion may further comprise a peptizing agent. Peptizing agents are generally soluble ionic compounds which are believed to cause the surface of a particle or colloid to be uniformly charged in a liquid medium (e.g., water). The preferred peptizing agents are acids or acidic compounds. Examples of typical acids include acetic, hydrochloric, formic and nitric acid, with nitric acid being preferred. The amount of acid added depends upon factors such as the dispersibility of the boehmite, the solids content of the dispersion, the components in the dispersion, the amount(s) of the components in the dispersion, the particle sizes of the components, and/or the particle size distribution of the components. Typically, the dispersion contains 1 to 10% by weight, preferably 3% to 8% by weight acid, based on the weight of boehmite in the dispersion.

In one aspect of producing sol gel abrasive particles, the dispersion further comprises a metal oxide precursor (also referred to as a metal oxide modifier). The term metal oxide precursor means that the material is capable of being converted into metal oxide with the appropriate sintering conditions. The amount of metal oxide precursor added to the dispersion is calculated and determined based upon the desired amount of metal oxide in the resulting abrasive particles. Metal oxides may alter the physical properties and chemical properties of the resulting abrasive particles.

The metal oxide precursor may be added to the dispersion as: 1) a metal salt, 2) a metal oxide particle or 3) a colloidal suspension of the metal oxide. Preferably, the metal oxide precursor is added as a metal salt. Examples of metal salts include metal nitrate salts, metal acetate salts, metal citrate salts, metal formate salts, and metal chloride salts. For metal oxide particles, it is generally preferred that the metal oxide particles are generally less than 5 microns, preferably less than one micron in size. Colloidal metal oxides are discrete finely divided particles of amorphous or crystalline metal oxide having one or more of their dimensions within a range of about 3 nanometers to about one micrometer.

Examples of metal oxides includes lithium oxide, manganese oxide, chromium oxide, praseodymium oxide, dysprosium oxide, samarium oxide, cobalt oxide, zinc oxide, neodymium oxide, yttrium oxide, ytterbium oxide, magnesium oxide, nickel oxide, silica, manganese oxide, lanthanum oxide, gadolinium oxide, dysprosium oxide, europium oxide, ferric oxide, hafnium oxide, erbium oxide, and zirconium oxide.

Certain metal oxides may react with the alumina to form a reaction product and/or crystalline phases with the alumina which may be beneficial during use of the abrasive in abrading applications. The reaction products of praseodymium oxide, ytterbium oxide, erbium oxide, and samarium oxide with aluminum oxide generally have a perovskite and/or garnet structure. The oxides of cobalt, nickel, zinc, and magnesium typically react with alumina to form the spinel phase. This reaction product may be described as $MAlO_4$, where M is the divalent metal ion. Yttria may react with the alumina to form $Y_3Al_5O_{12}$. Certain rare earth oxides and divalent metal cations react with alumina to form a rare earth aluminate represented by the formula $LnMAl_{11}O_{19}$, wherein Ln is a trivalent metal cation such as $La^{3+}$, $Nd^{3+}$, $Ce^{3+}$, $Pr^{3+}$, $SMm^{3+}$, $Gd^{3+}$, $Er^{3+}$, or $Eu^{3+}$, and M is a divalent metal cation such as $Mg^{2+}$, $Mn^{2+}$, $Ni^{2+}$, $Zn^{2+}$, or $Co^{2+}$. Such aluminates have a hexagonal crystal structure.

The alumina based dispersion may further comprise a nucleating material such as alpha alumina, alpha iron oxide, and/or an alpha iron oxide precursor. Additional details regarding nucleating materials are disclosed, for example, in U.S. Pat. No. 4,623,364 (Cottringer et al.), U.S. Pat. No. 4,744,802 (Schwabel), U.S. Pat. No. 4,964,883 (Morris et al.), U.S. Pat. No. 5,139,978 (Wood), and U.S. Pat. No. 5,219,806 (Wood).

A preferred nucleating material is alpha iron oxide or an alpha iron oxide precursor. Sources of iron oxide, which in some cases may act as or provide a material that acts as a nucleating material, include hematite (i.e., $\alpha$-$Fe_2O_3$), as well as precursors thereof (i.e., goethite ($\alpha$-FeOOH), lepidocrocite ($\gamma$-FeOOH), magnetite ($Fe_3O_4$), and maghemite ($\gamma$-$Fe_2O_3$)). Suitable precursors of alpha iron oxide include iron-containing material that will convert to $\alpha$-$Fe_2O_3$ when heated. Additional details regarding the addition of iron sources to the dispersion are reported in U.S. Pat. No. 5,611,829 (Monroe et al.) and U.S. Pat. No. 5,645,619 (Erickson et al.).

The alumina based dispersion typically comprises greater than 15% by weight (generally from greater than 30% to about 80% by weight) solids, based on the total weight of the dispersion. The dispersion may be prepared, for example, by gradually adding a liquid component(s) to a component(s) that is non soluble in the liquid component(s), while the latter is mixing or tumbling. For example, a liquid containing water, nitric acid, and metal salt may be gradually added to boehmite, while the latter is being tumbled such that the liquid is more easily distributed throughout the boehmite. Suitable mixers include pail mixers, sigma blade mixers, and high shear mixers. Other suitable mixers may be available from Eirich Machines, Inc. of Gurnee, Ill.; Hosokawa-Bepex Corp. of Minneapolis, Minn. (including a mixer available under the trade designation "SCHUGI FLEX-O-MIX", Model FX-160); and Littleford-Day, Inc. of Florence, Ky.

The alumina based dispersion typically gels prior to, or during, the drying step. Optionally, ammonium acetate or other ionic species may be added to induce gelling of the dispersion. The pH of the dispersion and concentration of ions in the gel generally determines how fast the dispersion gels. Typically, the pH of the dispersion is within a range of about 1.5 to about 4.

The alumina based dispersion (including in this context a gelled dispersion, or even partially dried dispersion) may be converted into elongated precursor material (e.g., rods (including cylindrical rods and elliptical rods)), for example, by extrusion. Examples of suitable extruders include ram, single screw, twin screw, and segmented screw extruders. Suitable extruders are available from Loomis Products of Levitown, Pa., Bonnot Co. of Uniontown, Ohio, and Hosokawa-Bepex of Minneapolis, Minn., which offers an extruder under the trade designation "EXTRUD-O-MIX" (Model EM-6). The rod shaped material typically has a diameter such that the sintered abrasive particles will have a diameter of about 150–5000 micrometers, and preferably, an aspect ratio of at least 2:1 (more preferably at least 4:1, or even at least 5:1). The extruded dispersion may be cut or sliced, for example, to provide discrete particles, and/or to provide particles having a more uniform length. Examples of methods for cutting (or slicing) the dispersion include blade cutters and wire cutters. The extruded dispersion may also be shredded and/or grated. Additional details concerning extrusion of alumina dispersions are reported in U.S. Pat. No. 5,776,214 (Wood) and U.S. Pat. No. 5,779,743 (Wood).

Techniques for drying the alumina based dispersion are known in the art and include, for example, heating or drying in air. The drying step generally removes a significant portion of the liquid medium from the dispersion, however, there still may be a minor portion (e.g., about 10% or less by weight) of the liquid medium present in the dried dispersion. Typical drying conditions include temperatures ranging from about room temperature to about 200° C., typically between 50 to 150° C. Drying times may range from about 30 minutes to several days.

The dried alumina based dispersion may be converted into precursor particles (i.e., particles which upon sintering form alpha alumina abrasive particles). One way to generate precursor particles is by a crushing technique. Various crushing techniques may be employed such as a roll crusher, jaw crusher, hammer mill, ball mill and the like. Coarser particles may be recrushed to generate finer particles. It is generally preferred that the dried dispersion be crushed to approximately the desired particle size distribution prior to sintering since it is generally easier to crush the dispersion than to crush sintered particles.

Alternatively, the alumina based dispersion may be converted into precursor particles prior to the drying step. For example, the dispersion may be extruded into rods that are subsequently cut to the desired lengths and then dried. Alternatively, the dispersion may be molded into a triangular shape particle and then dried. Additional details concerning triangular shaped particles may be found in U.S. Pat. No. 5,201,916 (Berg et al.).

It is within the scope of this invention to use a calcining step prior to the sintering step. In general, techniques for calcining the dried dispersion, wherein essentially all the volatiles are removed, and the various components that were present in the dispersion are transformed into oxides, are known in the art. Such techniques include using a rotary or static furnace to heat dried dispersion at temperatures ranging from about 400–1000° C. (typically from about 450–800° C.) until residual water and typically until at least about 90% weight of any bound volatiles are removed.

It is also within the scope of this invention to impregnate precursor particles with a metal oxide. The metal oxide is selected to provide the desired abrading characteristic(s) in the abrasive particles. Typically the metal oxide is added in the form of a metal salt or mixture of metal salts. Suitable metal oxide salts are described above.

Methods of impregnating are described, for example, in U.S. Pat. No. 5,164,348 (Wood) (also see, U.S. Ser. No. 08/781,557, filed Jan. 9, 1997). In general, dried or calcined precursor particles are porous. For example, calcined precursor particle may have pores about 5–10 nanometers in diameter extending therein from an outer surface. The presence of such pores allows an impregnation composition (i.e., a mixture comprising liquid, typically water, and a metal oxide salt) to enter into the precursor particles.

The liquid used for the impregnating composition is preferably water (including deionized water), an organic solvent (preferably a non-polar solvent), or a mixture thereof. If impregnation of a metal salt is desired, the concentration of the metal salt in the liquid is typically in the range from about 5% to about 40% dissolved solids, on a theoretical metal oxide basis. Preferably, at least 50 ml of solution is added to achieve impregnation of 100 grams of porous precursor particles, more preferably, at least about 60 ml of solution is added to impregnate 100 grams of porous precursor particles.

In some instances, more than one impregnation step may be utilized. The same impregnation composition may be applied in repeated treatments, or subsequent impregnation compositions may contain different concentrations of the same salts, different salts, or a different combination of salts.

After the impregnation step, the resulting impregnated precursor particles are typically calcined a second type to remove any volatiles prior to sintering. The conditions for this second calcining step are described above.

After the precursor particles are formed, they are sintered to provide ceramic alpha alumina based abrasive particles.

Thc precursor particles may be sintered by heating (e.g., using electrical resistance, microwave, plasma, laser, or gas combustion) on a batch basis or a continuous basis. The sintering temperatures will usually range from about 1200° C. to about 1650° C., preferably ranging from about 1200° C. to about 1500° C. The length of time which the precursor particles are sintered depends, for example, on particle size, composition of the particles, and the sintering temperature. Typically, the sintering time ranges from a few seconds to about 60 minutes, preferably ranging from about 3–30 minutes. Sintering is typically accomplished in an oxidizing atmosphere, although neutral or reducing atmospheres may also be useful.

There are numerous techniques for preparing sharp sol gel abrasive particles. For example, techniques for preparing sharp sol gel abrasive particles include:

(1) separating sharp abrasive particles from a mixture including both sharp and blocky abrasive particles;

(2) crushing the dried dispersion (prior to calcining or sintering) under conditions which will produce precursor particles which upon sintering will form sharp abrasive particles;

(3) producing sol gel abrasive flakes;

(4) breaking the dried precursor particles during calcining into smaller pieces;

(5) producing shaped sol gel abrasive particles; and (6) impregnating calcined precursor particles, under pressure, with metal oxide precursor(s).

A first method of producing sharp sol gel abrasive particles is to separate sharp particles from a mixture of blocky and sharp sol gel abrasive particles. This separation method is described above, and it is the same for conventional fused abrasive particles as for sol gel abrasive particles.

A second method of producing sharp sol gel abrasive particles involves crushing the dried alumina based dispersion into precursor particles such that upon sintering the precursor particles form sharp abrasive particles. The dried dispersion can be crushed according to any conventional crushing technique, for example, roll crushing, jaw crushing, or hammer mill crushing. The crushing conditions should be controlled such that abrasive particles having the desired bulk density, mean particle volume ratio and/or aspect ratio are produced. For example, the rotational speed and/or the pressure applied can alter the bulk density and particle size of the abrasive. Additionally, the chemical composition and percent moisture may significantly affect the physical properties of the dried gel and thus may affect how the dried gel crushes. One skilled in the abrasives art should be able to determine the appropriate chemical composition, percent moisture and crushing conditions to achieve sharp abrasive particles.

A third method of producing sharp sol gel abrasive particles involves producing sol gel abrasive flakes. This method is reported, for example, in U.S. Pat. No. 4,848,041 (Kruschke). In a preferred method for producing sol gel abrasive flakes, a dispersion is extruded into a relatively thin sheet, which is then dried. It may be preferred that the percent solids in the dispersion is relatively low, such that the resulting dried sheet is relatively thin. Additionally, it may be preferred to select drying conditions such that excessive cracking of the sheet is avoided. For example, it may be preferred to dry the sheet slowly to prevent excessive cracks from forming. After drying, the resulting sheet is crushed to produce precursor particles. These precursor particles are then calcined and sintered, as described above, to produce sharp abrasive particles.

A fourth method of producing sharp sol gel abrasive particles is to promote conditions wherein the precursor particles break into smaller pieces during the calcining process. During calcining, residual moisture and volatiles are typically removed from precursor particles by heating. This may create cracks and porosity in the precursor particles. In some instances, the cracks are sufficiently large or they propagate such that the precursor particle breaks into smaller pieces. The smaller pieces may be shaped such that upon sintering they form sharp abrasive particles. The number of precursor particles and the degree to which the precursor particles break may depend upon factors such as the heating rate, kiln rotation rate, level of moisture in the dried gel, volatiles in the dried gel and the like. Higher heating rates and/or higher volatiles in the precursor particles may result in greater percentages of broken particles during calcining. More specific details of this process are reported in U.S. Pat. No. 5,725,162 (Garg et al.).

A fifth method to produce sharp sol gel abrasive particles involves forming shaped abrasive particles. For example, shaped abrasive particles may be in the form of rods having an aspect ratio of at least 1.5:1, preferably at least 2:1. The rods will have essentially a uniform cross sectional area and may be curved or straight in nature. The rods are typically formed by extruding an alumina dispersion to form long rod shaped lengths. The rod shaped lengths are then dried, and are cut or broken to produce the desired lengths. Alternatively, the rods may be cut or broken to the desired lengths immediately after extrusion. Subsequently, the rods are dried, calcined and sintered.

Shaped sol gel abrasive particles may also be triangular in shape. To make triangular shaped sol gel abrasive particles, the dispersion is first molded to produce the desired triangular shape. During molding a sufficient portion of the water is removed (i.e., the dispersion is at least partially dried) to retain the triangular shape upon further processing. After the precursor particles are removed from the mold, they may be further dried. After drying, the triangular shaped precursor particles are calcined and sintered, as described above.

Additional details concerning shaped sol gel abrasive particles are reported in U.S. Pat. No. 5,009,676 (Rue et al.), U.S. Pat. No. 5,035,723 (Kalinowski et al.) U.S. Pat. No. 5,090,968 (Pellow), U.S. Pat. No. 5,201,916 (Berg et al.), U.S. Pat. No. 5,227,104 (Bauer), U.S. Pat. No. 5,366,523 (Rowenhorst et al.), and U.S. Pat. No. 5,372,620 (Rowse et al.).

A sixth method to produce sharp sol gel abrasive particles involves an impregnation process. First, a dried alumina based dispersion is crushed into precursor particles which are then calcined. After calcining, the precursor particles are impregnated with metal oxide precursor(s), typically metal salt(s). The calcined precursor particles are somewhat porous and the metal salts migrate into the pores by capillary action. Pressure can be applied during this impregnation process. This causes at least some of the precursor particles to break into smaller pieces. These smaller pieces tend to result, after sintering, in sharp abrasive particles. Pressure can be applied, for example, by compressed air. Additional details concerning impregnation are reported in assignee's U.S. patent applications having Ser. No. 09/081,365 (filed May 19, 1998) and Ser. No. 08/781,557 (filed Jan. 9, 1997).

Grinding Aid

Abrasive articles in accordance with the invention include a grinding aid. In a preferred embodiment, an abrasive article according to the invention includes a peripheral surface including a grinding aid formed from a mixture including an acid and an inorganic metal phosphate salt, an inorganic metal sulfate salt, or a mixture thereof. Inorganic metal phosphate salts are selected from the group of alkali metal phosphate salts and alkaline earth metal phosphate salts. Inorganic metal sulfate salts are selected from the group of alkali metal sulfate salts, alkaline earth metal sulfate salts, and transition metal sulfate salts.

Preferably, the acid is selected such that the mixture forms a film, as defined above. Preferred phosphates of an alkali metal or an alkaline earth metal are selected from the group of tripotassium orthophosphate ($K_3PO_4$), trisodium orthophosphate ($Na_3PO_4$), tricalcium orthophosphate ($Ca_3(PO_4)_2$), sodium pyrophosphate ($Na_4P_2O_7$), potassium pyrophosphate ($K_4P_2O_7$), and mixtures thereof. Preferred sulfates are selected from the group of sodium sulfate ($Na_2SO_4$), potassium sulfate ($K_2SO_4$), cesium sulfate ($Cs_2SO_4$), copper(II) sulfate ($CuSO_4$), iron(II) sulfate ($FeSO_4$), manganese(II) sulfate ($MnSO_4$), cobalt(II) sulfate ($CoSO_4$), or mixtures thereof.

Tripotassium orthophosphate is commonly described as $K_3PO_4$. The physical nature of $K_3PO_4$ is that it is colorless, rhombic, and deliquescent. When a water-soluble solid, such as $K_3PO_4$, acquires sufficient water of hydration it will dissolve in the water and form a solution. Anhydrous forms of $K_3PO_4$ are commercially available, for example, from Aldrich Chemical Co., Milwaukee, Wis. In either instance, it is speculated that the hygroscopic nature of inorganic metal phosphate salts, such as $K_3PO_4$ or $Na_3PO_4$, is due to the proton affinity of $PO_4^{3-}$ in $H_2O$.

While not wishing to be bound by any particular theory, it is believed that by including an acid, preferably an organic acid, in a grinding aid, the hygroscopic nature of the inorganic metal phosphate, such as $K_3PO_4$ or $Na_3PO_4$, is suppressed prior to including it on an abrasive article. For example, if an organic acid, such as one selected from the group of citric acid, lactic acid, oxalic acid, tartaric acid, and mixtures thereof, is mixed with an inorganic metal phosphate salt, such as $K_3PO_4$, the resulting mixture is substantially less hygroscopic and is advantageously capable of forming a film when coated on an abrasive article.

A suitable mixture may also be formed by reacting a mineral acid (e.g., $H_3PO_4$), a salt of a mineral acid (e.g., $KH_2PO_4$ or $K_2HPO_4$), or a mixture thereof with a salt of an organic acid (e.g., potassium citrate, mono, di, or tribasic salt).

Thus, in another preferred embodiment, an abrasive article according to the invention includes a peripheral surface including a grinding aid formed from a mixture including a mineral acid, salt of a mineral acid, or mixture thereof and a salt of an organic acid.

Yet another preferred mixture that produces a grinding aid in an abrasive article according to the invention may be formed from a mixture including an acid component, and a compound containing an alkali metal or an alkaline earth metal, with the provisos that:

(i) when the acid component consists essentially of an organic acid, the compound containing an alkali metal or an alkaline earth metal comprises a phosphate salt or a sulfate salt thereof; and (ii) when the acid component consists essentially of a combination of an organic acid and a mineral acid, the component containing an alkali metal or an alkaline earth metal comprises a base thereof.

Preferably, the mineral acid is selected from the group of hydrochloric acid, nitric acid, sulfuric acid, phosphoric acid, tetrafluoroboric acid, and mixtures thereof.

Accordingly, it is desirable that the mixture forming the grinding aid, as described above, preferably has a pH of about 4.5 to about 8.5, more preferably about 5.0 to about 8.0, and most preferably about 5.5.

It is also desirable in the mixture forming the grinding aid, as described above, that the range of equivalents is preferably about 0.5 to about 2.0 parts acid to about 1.0 part phosphate or sulfate, more preferably about 0.75 to about 1.5 parts acid to about 1.0 part phosphate or sulfate, and most preferably about 1.0 part acid to about 1.0 part phosphate or sulfate.

For the grinding aid mixture described in proviso (ii), it may be advantageous to first mix at least a portion of two of the components with one another, followed by the addition of the third component. For example, the mineral acid and the base (or a portion of the mineral acid and/or base) may be mixed first, followed by the addition of the organic acid to the mixture. Optionally, intermediates (i.e., the reaction product of two the components) may be isolated prior to the addition of the third component. Depending upon the amounts mixed, organic acid salts (e.g., potassium citrate, mono, di, or tribasic salt) or mineral acid salts (e.g., $K_3PO_4$, $KH_2PO_4$) may be formed as intermediates.

Optionally, it may be advantageous to include a binder precursor in a mixture used to form a grinding aid, as described above. Preferably, the mixture that forms the grinding aid further includes a binder precursor that is compatible with a mixture including an inorganic metal phosphate salt and an acid. By "compatible," it is meant that there is preferably no substantial phase separation between the binder precursor, the inorganic metal phosphate salt and the acid. Suitable binder precursors include, for example, phenolic resins, aminoplast resins having pendant $\alpha,\beta$-unsaturated carbonyl groups, urethane resins, epoxy resins, urea-formaldehyde resins, isocyanurate resins, melamine-formaldehyde resins, acrylate resins, acrylated isocyanurate resins, acrylated urethane resins, acrylated epoxy resins, bismaleimide resins, and mixtures thereof.

When present, the optional binder precursor is generally in an amount of about 50% by dry weight or less, typically about 40% by dry weight or less of the mixture. When coated on a substrate, the mixture including a binder precursor, an inorganic metal phosphate salt and an acid generally forms a substantially continuous film upon substantial removal of water that may be present in the mixture. Although not wishing to be bound by theory, it is believed that in an abrasive article according to the invention, the binder, inorganic metal phosphate salt and acid forms a film that is eroded away, allowing for the introduction of the grinding aid to the grinding interface between an abrasive article and a workpiece.

Optional Additives

Optional additives, such as, for example, fillers (secondary grinding aids), fibers, antistatic agents, lubricants, wetting agents, surfactants, pigments, dyes, coupling agents, plasticizers, release agents, suspending agents, rheology modifiers, and curing agents including free radical initiators and photoinitiators, may be included in abrasive articles of the present invention. The optional additives may be included in a binder formed from a binder precursor. These optional additives may further require that additional components be included in the binder precursor composition to aid in curing; for example, a photoinitiator may be required when acrylates are used. The amounts of these materials can be selected to provide the properties desired.

For example, a binder can be formed from a composition including a binder precursor that can further include a wetting agent, preferably, a nonionic surfactant.

Examples of useful fillers for this invention include: metal carbonates, such as calcium carbonate (chalk, calcite, marl, travertine, marble and limestone), calcium magnesium carbonate, sodium carbonate, magnesium carbonate; silica (such as quartz, glass beads, glass bubbles and glass fibers); silicates, such as talc, clays, montmorillonite, feldspar, mica, calcium silicate, calcium metasilicate, sodium aluminosilicate, sodium silicate; metal sulfates, such as calcium sulfate, barium sulfate, sodium sulfate, aluminum sodium sulfate, aluminum sulfate; gypsum; vermiculite; wood flour; aluminum trihydrate; carbon black; metal oxides, such as calcium oxide, aluminum oxide, iron oxide, titanium dioxide; and metal sulfites, such as calcium sulfite. Examples of useful fillers also include silicon compounds, such as silica flour, e.g., powdered silica having a particle size of from about 0.4 to 10 microns (available from Akzo Chemie America, Chicago, Ill.), and calcium salts, such as calcium carbonate and calcium metasilicate (available under the trade designations, "WOLLASTOKUP" and "WOLLASTONITE" from Nyco Company, Willsboro, N.Y.).

Examples of antistatic agents include graphite, carbon black, vanadium oxide, humectants, and the like. These antistatic agents are disclosed in U.S. Pat. Nos. 5,061,294; 5,137,542; and 5,203,884.

A coupling agent can provide an association bridge between the binder and the filler particles. Additionally the coupling agent can provide an association bridge between the binder and the abrasive particles. Examples of coupling agents include silanes, titanates, and zircoaluminates. There are various means to incorporate the coupling agent. For example, the coupling agent may be added directly to the binder precursor. The binder may contain anywhere from about 0.01% to 3% by weight coupling agent. Alternatively, the coupling agent may be applied to the surface of the filler particles or the coupling agent may be applied to the surface of the abrasive particles prior to being incorporated into the abrasive article. The abrasive particles may contain anywhere from about 0.01% to 3% by weight coupling agent.

Rheology modifiers can be added to the binder precursor to enhance the manufacturing process for abrasive articles of the invention. Such rheology modifiers can include water-based dispersions of polymers (e.g., polyacrylic acid). Additionally, grinding performance may be improved when an abrasive article includes such rheology modifiers.

Curing agents such as an initiator may be used, for example, when the energy source used to cure or set a binder precursor is heat, ultraviolet light, or visible light in order to generate free radicals. Examples of curing agents such as photoinitiators that generate free radicals upon exposure to ultraviolet light or heat include organic peroxides, azo compounds, quinones, nitroso compounds, acyl halides, hydrazones, mercapto compounds, pyrylium compounds, imidazoles, chlorotriazines, benzoin, benzoin alkyl ethers, diketones, phenones, and mixtures thereof. Commercially available photoinitiators include those available from Ciba Geigy Company, Hawthorne, N.Y., under the trade designations "IRGACURE 651" and "IRGACURE 184" and those available from Merck & Company, Incorporated, Rahway, N.J., under the trade designation "DAROCUR 1173" (all of which generate free radicals upon exposure to ultraviolet light) and those available from Ciba Geigy Company, Hawthorne, N.Y., under the trade designation "IRGACURE 369" (which generates free radicals upon exposure to visible light). In addition, initiators which generate free radicals upon exposure to visible light as described in U.S. Pat. No. 4,735,632. Typically, an initiator is used in amounts ranging from about 0.1% to about 10% by weight, preferably about 2% to 4% by weight, based on the weight of the binder precursor.

In addition to the grinding aid formed from an inorganic metal phosphate salt and an acid, it is also within the scope of the present invention to include a secondary grinding aid. Secondary grinding aids encompass a wide variety of different materials and can be inorganic or organic based. Examples of chemical groups of grinding aids include waxes, organic halide compounds, halide salts and metals and their alloys. Examples of such materials include chlorinated waxes like tetrachloronaphthalene, pentachloronaphthalene, and polyvinyl chloride. Examples of halide salts include sodium chloride, potassium aluminum hexafluoride, sodium aluminum hexafluoride, ammonium aluminum hexafluoride, potassium tetrafluoroborate, sodium tetrafluoroborate, silicon fluorides, potassium chloride and magnesium chloride. Examples of metals include tin, lead, bismuth, cobalt, antimony, cadmium, iron, and titanium. Other miscellaneous grinding aids include sulfur, organic sulfur compounds, graphite, and metallic sulfides. The above mentioned examples of grinding aids are meant to be a representative listing of grinding aids, and it is not meant to encompass all grinding aids usable.

Method for Making Abrasive Articles

The manipulative steps of the process for making coated abrasive articles of the invention can be essentially the same as those currently practiced in the art. Coated abrasives generally consist of a backing, abrasive particles, and at least one binder to hold the abrasive particles to the backing. The backing typically is saturated with a saturant coat precursor by any conventional technique such as dip coating, roll coating, powder coating, or hot melt coating. For purposes of making the coated abrasive article of this invention, not only the saturant coat precursor, but also the backsize coat precursor, the presize coat precursor, the make coat precursor, the size coat precursor, and the supersize precursor, are each fully cured, or at least either dried or partially cured after application to an extent such that the coating is dry to the touch before the next coat is applied. After the last coat is applied, and if necessary, the remaining partially cured coats are fully cured.

After the saturant coat is applied, the backsize or presize coat precursors are applied by any conventional technique such as spray coating, roll coating, die coating, powder coating, hot melt coating, or knife coating. The coated abrasive then comprises providing on the backing a first binder precursor that will form a binder commonly referred to as a make coat, on one side of the backing. Then, abrasive particles are at least partially embedded into the make coat binder precursor by conventional projection techniques, such as by an electrostatic coating process, before the make coat is partially dried or cured. The make coat binder precursor is then partially dried or cured, and a second binder precursor is applied over the make coat and abrasive particles. The second binder precursor forms a second binder commonly referred to as a size coat. The size coat binder precursor is applied in a liquid or flowable form over the abrasive particles and make coat. The size coat, and if still necessary, the make coat, are then fully cured. Notably, if a thermoplastic resin is used alone for any of the binders, the thermoplastic resin can be cooled in order to solidify. Thus, for the purpose of this application, the term "cure" refers to the polymerization, gelling, or cooling procedure necessary to convert a binder precursor into a binder. Therefore, "at least partially curing" refers to at least partially polymerizing, gelling, or cooling a binder precursor.

The make and size coats can be applied by any number of techniques such as roll coating, spray coating, curtain coating, and the like. In some instances, a third coating or a supersize coat is applied over the size coat by conventional techniques. The make, size, and supersize coats can be cured either by drying or the exposure to an energy source such as thermal energy, or radiation energy including electron beam, ultraviolet light, and visible light. The choice of the energy source will depend upon the particular chemistry of the resinous adhesive.

In accordance with the invention, a peripheral surface of an abrasive article is formed from a mixture including an inorganic metal phosphate salt and an acid. These components may be added in any order. Upon mixing, the mixture turns substantially clear and may reach a temperature of at least about 75° C. due to the heat of dissolution/ neutralization.

A peripheral surface is formed by coating the mixture on a surface of an abrasive article that will ultimately contact a workpiece. For example, in the case of a coated abrasive article, the mixture is preferably coated over the size coat. In the case of a structured abrasive article, the mixture is coated over the precisely shaped composites or it may be admixed with the plurality of abrasive particles to form the precisely shaped composites. Coating the mixture can be accomplished by a variety of conventional techniques, such as spray coating or roll coating. Drying of the coating containing the inorganic phosphate and a binder precursor can be accomplished by drying under conditions sufficient to drive off solvent/water present in the binder precursor, such as at a temperature of about 30° C. to about 150° C., preferably about 50° C. to about 125° C., and more preferably about 85° C. for about 1.5 to about 3 hours.

Additionally, in accordance with the invention, a peripheral surface may be formed from a mixture further including a binder precursor, as described above. The resulting mixture of a binder precursor, an organic acid and an inorganic metal phosphate can be coated on an abrasive article by coating techniques such as roll coating or spray coating. The roll coater can be a single roll coater, e.g. a coating roll of 60 Shore A durometer with a metal back-up roll, forming a nip with a soft opposing roll.

Also, the abrasive products of the present invention can be readily converted into various geometric shapes to suit the contemplated application, such as discrete sheets, disc forms, endless belt forms, conical forms, and so forth, depending on the particular abrading operation envisioned.

Method for Using an Abrasive Article

An abrasive article in accordance with the invention is generally brought into frictional contact with an outer surface of a workpiece. The abrasive products of the present invention are not limited as to the types of workpiece that can be abraded therewith. By "abrading," the term as used herein generally can mean any of grinding, polishing, finishing, and the like.

Workpiece

The workpiece can be any type of material such as metal, metal alloys, exotic metal alloys, ceramics, glass, wood, wood-like materials, composites, painted surfaces, plastics, reinforced plastic, stone, and combinations thereof. The workpiece may be flat or may have a shape or contour associated with it. The abrasive articles of this invention are particularly well suited for difficult to abrade metal grinding operations, especially stainless steel, high nickel alloy, and titanium workpieces. In particular, titanium workpieces include jet blades, golf club heads, and aerospace components.

Depending upon the application, the load at the abrading (or grinding) interface can range from about 0.1 to 489 N or more, typically from about 9.8 to 29.4 N. Optionally, there may be a liquid present during abrading.

For belt applications, two free ends of an abrasive sheet are joined together and a splice is formed. However, it is also within the scope of the invention to use a spliceless belt, such as that described in U.S. Pat. No. 5,573,619 (Benedict et al.). Generally, the endless abrasive belt traverses over at least one idler roll and a platen or contact wheel. The hardness of the platen or contact wheel is adjusted to obtain the desired rate of cut and workpiece surface finish. The abrasive belt speed ranges from about 500 to 3000 surface meters per minutes, typically from about 750 to about 3000 surface meters per minute. The belt speed depends upon the desired cut rate and surface finish. Abrasive belt dimensions are generally about 5 mm to about 1,000 mm wide and about 5 mm to about 10,000 mm long.

While abrasive articles in accordance with the invention have been described herein, the following non-limiting examples will further illustrate the invention.

EXAMPLES

All parts, percentages, ratios, etc., in the examples are by weight unless otherwise indicated. The following designations are used throughout the examples:

Materials used in Coated Abrasive Articles

Epoxy resin

BPAW: an epoxy resin composition containing a diglycidyl ether of bisphenol A epoxy resin coatable from water containing approximately 60% solids, 40% water, a nonionic emulsifier; having an epoxy equivalent weight range from about 600 to about 700; commercially obtained from Shell Chemical Co., Louisville, Ky., under the trade designation "CMD 35201."

Acrylic binder

NC-6075: an acrylic binder composition of an acrylic copolymer emulsion having 46% solids in water, having the trade designation "NeoCryl XA-6075," was commercially obtained from Zeneca Division of ICI America, Wilmington, Mass.

Phenolic resin

RP1: a water-based resole phenolic resin with 75% solids (non-volatile).

Curing agent

EMI: 25% solids aqueous solution of 2-ethyl-4-methyl imidazole curing agent, having the trade designation "EMI-24," was commercially obtained from Air Products, Allentown, Pa.

Grinding aids

Inorganic metal phosphate salts $K_3PO_4$: anhydrous tripotassium orthophosphate, was commercially obtained from Aldrich Chemical Co., Milwaukee, Wis.

$Na_3PO_4$: trisodium orthophosphate tribasic dodecahydrate, was commercially obtained from EM Science, Gibbstown, N.J.

Organic acids and salts

CA: citric acid 99+% purity, was commercially available from Alfa Johnson Matthey, Ward Hill, Mass.

TA: tartartic acid was commercially available from Fisher Scientific, Pittsburgh, Pa.

OA: oxalic acid was commercially available from Matheson, Coleman Bell.

LA: lactic acid 85% in water, was commercially available from Fisher Scientific, Pittsburgh, Pa.

$K_3Ct$-$H_2O$ potassium citrate, tribasic salt, monohydrate commercially available from Milsolv Minnesota Corp., Roseville, Minn.

Inorganic acid $H_3PO_4$ 85% phosphoric acid commercially available from Van Waters & Rogers, St. Paul, Minn.

Inorganic base

KOH potassium hydroxide pellets commercially available from Alfa Aesar, Ward Hill, Mass.

Optional Additives

Secondary grinding aid $KBF_4$: 98% pure micropulverized potassium tetrafluoroborate, in which a 95% fraction by weight passes through a 325 mesh screen and a 100% fraction by weight passes through a 200 mesh screen.

CRY sodium aluminum hexafluoride; cryolite Fillers $CaCO_3$ calcium carbonate

IO: red iron oxide.

SM: sodium metasilicate, commercially available from Fisher Scientific, Pittsburgh, Pa.

Dispersing agent

AOT: sodium dioctyl sulfosuccinate, having the trade designation "Aerosol OT," was commercially obtained from Rohm & Haas Company, Philadelphia, Pa.

Solvent

HP: a 15/85 blend of water and propylene glycol monomethyl ether, commercially available from Worum Chemical Co., St. Paul, Minn., under the trade designation "POLY-SOLVE."

Wetting agent

133: "INTERWET 33" containing a glycol ester of fatty acids and commercially obtained from Interstab Chemicals, New Brunswick, N.J.

Materials used in Endless-seamless Abrasive Articles

PET1NW: a spunbonded polyester nonwoven mat approximately 0.127 mm thick and weighed approximately 28 g/square meter, purchased from the Reemay Corporation, Old Hickory, TN, under the trade designation "REEMAY."

PET: polyethylene terephthalate.

CAT: complex of methylene dianiline and sodium chloride dispersed in dioctyl phthalate, purchased from Uniroyal Chemical Co., Inc., Middlebury, Conn. under the trade designation "CAYTUR 31."

VIB: polyether based toluene diisocyanate terminated prepolymer polyurethane elastomer commercially available from Uniroyal Chemical Co., Inc., Middlebury, Conn., under the trade designation "VIBRATHANE B-813."

EMI: 25% solids aqueous solution of 2-ethyl-4-methyl imidiazole, commercially available from Air Products, Allentown, Pa., under the trade designation "EMI-42."

SOL: an organic solvent, having the trade designation "AROMATIC 100," commercially available from Worum Chemical Co., St. Paul, Minn.

General Procedure 1 for Making Coated Abrasive Articles (Discs)

Coated abrasive articles in the general shape of a disc were prepared according to the following procedure. A 0.76 mm thick vulcanized fiber backing having a 2.2 cm diameter center hole was coated with a conventional calcium carbonate filled resole phenolic resin (83% by weight solids) to form a make coat. The wet coating weight was approximately about 80 g/m$^2$. Grade 80 silicon carbide abrasive particles were electrostatically coated onto the make coat at a weight of approximately about 200 g/m$^2$. The resulting abrasive article was precured for 150 minutes at 93° C. A size composition consisting of 33.2% RP1, 52.0% $CaCO_3$, 14.2% $H_2O$ and 0.6% HP was applied over the abrasive particles and the make coat at an average weight of approximately about 200 g/m$^2$ to form a size coat. All G-80 SiC fiber discs with standard $CaCO_3$ make and size coats; about 163 g/m$^2$ of supersize/disc (conventional $KBF_4$ supersize (29.2% BPAW, 0.35% EMI, 53.3 $KBF_4$, 14.1% water, 0.75% AOT and 2.3% 10)). The resulting product was cured for 12 hours at 100° C. After this step, the coated abrasive discs were flexed and humidified at 45% relative humidity for one week.

General Procedure 2 for Preparing an Endless-seamless Abrasive Articles

This procedure illustrates the general method of making an endless spliceless coated abrasive belt, according to the teachings of U.S. Pat. No. 5,573,619 (Benedict et al.).

The backing was formed over an aluminum hub which had a diameter of 19.4 cm and a circumference of 61 cm. The aluminum hub had a wall thickness of 0.64 cm and a width of 61 cm. It was installed on a 7.6 cm mandrel that rotated by a DC motor and was capable of rotating from 1 to 120 revolutions per minute (rpms). Over the periphery of the hub was a 0.05 millimeter thick silicone coated polyester film, which acted as a release surface. This silicone coated polyester film was not a part of the backing. On top of this release film was placed 60 pound paper. The final dimension of the abrasive was 53 cm wide by 61 cm long.

A nonwoven web approximately 3.8 cm wide was saturated with a backing coat precursor (63% VIB/21% CAT/14.5% SOL/1.5% IO) by means of a 5 cm wide knife coater with a gap setting of 0.23 mm. The knife coater was attached to a level winder and the nonwoven was helically wrapped onto the hub while the hub rotated at 5 rpm. Two layers of nonwoven were wrapped over the hub, the second layer was 180 degrees out of phase with the first. The adjacent wraps were applied such that they did appreciably overlap and the gap was less than 1 mm. Next, reinforcing strands or yams were applied into the backing coat precursor saturated nonwoven. The strands were first run through a tensioner and then wound through a comb, two at a time. The reinforcing fibrous strands were wrapped over the saturated nonwoven web by means of a yam guide system with a level winder that moved across the face of the hub at a rate of 10 cm per minute. During this process, the hub rotated at 120 rpm. This resulted in the spacing of the reinforcing strands of 24 strands per cm of width. The reinforcing strands were normally of different materials. The strand spacing was changed by the increase or decrease in the speed of the yarn guide. After strands were wound in over the width of the hub, the hub was removed and placed in a batch oven on rotating spindles. The spindles rotated at 10 rpm. The hub was kept in the oven for 5 minutes at 110° C.

Afterwards, the hub was removed from the oven and a make coat binder precursor of a conventional calcium carbonate filled resole phenolic resin (83% by weight solids) was sprayed on the cured backing coat surface. The sprayed backing was mounted on a rotating shaft above an electrically activated plate that was covered with abrasive particles. The hub acted as the ground plate. The abrasive particles were aluminum oxide or silicon carbide as specified in the description and Table 7. The total abrasive particle weight was about 270 g/meter square for SiC and about 395 g/meter square for $Al_2O_3$. As the hub rotated at 10 rpm during the activation of the electric field which coated the abrasive particles into the make coat precursor. After coating, the resulting construction was removed and placed in a batch oven on rotating spindles for 30 minutes at 100° C.

Next, the hub was mounted on a rotating shaft that rotated at 40 rpm. A size coat precursor was sprayed over the abrasive particles/make coat. The size coat precursor was 72% solids diluted with a 90/10 mixture of water and HP. The size coat precursor consisted of 32 parts RPI, 66 parts CRY and 2 parts IO. The size coat precursor weight was about 340 g/square meter. After spraying, the coated abrasive received a thermal cure of 60 minutes at 88° C.

After this thermal cure, the hub was remounted on the spray system and a supersize coating was sprayed over the size coat. The supersize coating consisted of 17 parts of BPAW, 76 parts $KBF_4$, 3 parts thickener, 2 parts IO, 2 parts EMI. The overall supersize was 72% solids in water. The supersize wet weight was about 132 g/square meter. The resulting construction was then thermally cured for 60 minutes at 88° C. and a final cure of 10 hours at 105° C. Prior to testing, the resulting coated abrasive was flexed by running over a 2.5 cm support bar and a raised spiral bar.

General Procedure 3 for Making Coated Abrasive Articles (Discs) Coated abrasive articles in the general shape of a disc were prepared according to the following procedure. A 0.76 mm thick vulcanized fiber backing having a 2.2 cm diameter center hole was coated with a conventional calcium carbonate filled RP1 (83% by weight solids) to form a make coat. The wet coating weight was approximately about 164 g/m$^2$. Grade 36 ceramic aluminum oxide abrasive particles were electrostatically coated onto the make coat at a weight of approximately about 900 g/m$^2$. The resulting abrasive article was precured for 150 minutes at 93° C. A size composition consisting of 35.% RPI, 54.45% CRY, 8.7% water, and 1.65% 10 was applied over the abrasive particles and the make coat at an average weight of approximately about 695 g/m$^2$ to form a size coat. The material was precured for 15–30 minutes at 65–70° C. and for 75 minutes at 88° C. Conventional $KBF_4$ supersize (29.2% BPAW, 0.35% EMI, 53.3 $KBF_4$, 14.1% water, 0.75% AOT and 2.3% 10) was applied to discs of Comparative Examples A, B, C resulting in about 389 g/m$^2$ of supersize. The overall supersize was 72% solids in water. The material was precured for 15–30 minutes at 65–70° C. and for four hours at 88–90° C. The resulting product was final cured for 12 hours at 100° C.

General Procedure 4 for Making Coated Abrasive Articles (Belts)

For the following examples the backing of each coated abrasive consisted of a Y weight woven polyester cloth which had a four over one weave. The 100% polyester 4/1 sateens fabric was made from open end spun yarns, weighing 326 gsm. This fabric was saturated with 90% resole phenolic resin and 10% nitrile latex to a weight of 416 gsm followed by heating to about 120° C. and maintaining this temperature until the resin had cured to a tack-free state. This is then backsized with a blend of 55% $CaCO_3$ and 43% of a blend of two resole phenolic resins (along with some IO and carbon black for color) to a weight of 516 gsm. The backing is then presized with the same solution as was used to saturate the cloth, to bring it up to the final wt of 549 gsm. Each of the above cloth treatments was followed by heating to about 120° C. and maintaining this temperature until the resin had cured to a tack-free state. The backing made by this procedure was completely pretreated and was ready to receive a make coat.

A coatable mixture for producing a make coating for each coated backing was prepared by mixing 49.2 parts of 70% solids RP1 (34.4 parts phenolic resin), 41.0 parts non-agglomerated calcium carbonate filler (dry weight basis), and 10.2 parts water to form a make coating in each case which was 84% solids, with a wet coating weight of 302 g/m$^2$. The make coating was applied in each case via roll coating. Next, grade 36 (ANSI standard B74.18 average particle size of 545 micrometers) ceramic aluminum oxide abrasive particles were electrostatically applied onto the uncured make coatings with a weight of 921 g/m$^2$. Then, the resulting constructions received a precure of 15 minutes at 65° C. followed by 75 minutes at 88° C.

An 82% solids coatable mixture suitable for forming a size coating consisted of 35.2% RP1, 54.45% CRY, 8.7% water, and 1.65% IO was then applied over the abrasive particles/make coating construction via two-roll coater. The wet size coating weight in each case was about 390 g/m$^2$. The resulting coated abrasives received a thermal cure of 30 minutes at 88° C. followed by 12 hours at 100° C.

After this thermal cure, the coated abrasives were single flexed (i.e., passed over a roller at an angle of 90° to allow a controlled cracking of the make and size coatings), then converted into 7.6 cm by 203 cm coated abrasive belts.

TEST PROCEDURE I

Fiber discs having a diameter of 17.8 cm, with a 2.2 cm diameter center hole and thickness of 0.76 mm were installed on a swing arm testing machine. The fiber discs were first conventionally flexed to controllably break the hard bonding resins, mounted on a rubber back-up pad, and used to grind the edge of a titanium disc workpiece. The disc was driven at 1710 rpm while the portion of the disc overlaying the beveled edge of the back-up pad contacted the workpiece at a force of 39.2 N. Each disc was used to grind the same workpiece for a total of either eight or ten minutes and the workpiece was weighed after every one minute of grinding. Data as shown in the tables that follow are labeled as "initial cut," which is the amount of material removed in the first 60 seconds of abrading; "final cut," which is the amount of material removed in the last 60 seconds of the test; and "total cut," which is the amount of material removed during the entire test procedure.

TEST PROCEDURE II

The coated abrasive article of each example was then converted into 7.6 cm by 335 cm endless abrasive belts. Two belts from each example were tested on a constant load surface grinder. A pre-weighed, titanium workpiece approximately 2.5 cm by 5 cm by 18 cm was mounted in a holder, positioned vertically, with the 2.5 cm by 18 cm face confronting approximately 36 cm diameter 60 Shore A durometer serrated rubber contact wheel and one on one lands over which entrained the coated abrasive belt. The workpiece was then reciprocated vertically through a 18 cm path at the rate of 20 cycles per minute, while a spring-loaded plunger urged the workpiece against the belt with a load of 107.7 N as the belt was driven at about 2,050 meters per minute. After thirty seconds of grinding time had elapsed, the workpiece holder assembly was removed and reweighed, the amount of stock removed calculated by subtracting the weight after abrading from the original weight. Then a new, pre-weighed workpiece and holder were mounted on the equipment. The experimental error on this test was about 10%. The total cut is a measure of the total amount of stainless steel removed throughout the test. The test was deemed ended when the amount of final cut was less than one third the amount of initial cut for two consecutive thirty-second intervals.

TEST PROCEDURE III

The coated abrasive belt (1.3 cm×61 cm) was installed on a Dynafile grinder robot test system. Belts ground for this test were grade 80. The workpiece for this test was 0.6 cm×5.1 cm×20.3 cm titanium bar. Workpieces and the abrasive belts are both weighed prior to the test. The workpiece is placed in a holder with the 20.3 cm face perpendicular to the grinder. The 0.6 cm edge is ground over a 2.5 cm length by oscillating the workpiece holder back and forth; using a cam assembly, over a 2.5 cm length. A notch 2.5 cm wide is ground into the workpiece to some depth depending on the cut rate. The belt is run for 2 minutes nonstop. The workpiece is removed from the holder and weighed along with the sample belt. Cut rate is equal to weight loss and mineral loss is equal to weight differential of the belt before and after grinding. The belt grinder used is a "Dynafile"(available from Dynabrade Inc.) with a 11218 contact arm. Belt speed was 76.2 standard m/min. Force measured at the grinding interface at the area of contact between the abrasive belt and metal workpiece was 12.7 N.

TEST PROCEDURE IV

A cured fiber disc having a diameter of 17.8 cm, with a 2.2 cm diameter center hole and a thickness of 0.76 mm was attached to a rubber back up pad and installed on a heavy flat test apparatus. The heavy flat test involved placing a workpiece in proximity to the outer periphery of the disc at the prescribed angle at the prescribed load for the prescribed time. The workpiece was a 304 stainless steel disc having a diameter of approximately 25.4 cm and a thickness of 0.18 cm. The edge shelling was conducted at a constant load (39.2 N). The coated abrasive disc traversed at 3500 rpm. The test endpoint was 16 minutes. The 304 stainless steel disc was weighed at 4 minute intervals during testing. The weight loss associated with the 304 stainless steel disc corresponded to the amount that the coated abrasive disc cut, i.e., the efficiency of the coated abrasive disc. Initial cut in grams after four minutes and final cut in grams after sixteen minutes were both recored.

TEST PROCEDURE V

Fiber discs having a diameter of 17.8 cm, with a 2.2 cm diameter center hole and thickness of 0.76 mm were installed on a slide action testing machine. The fiber discs were first conventionally flexed to controllably break the hard bonding resins, mounted on a beveled aluminum backup pad, and used to grind the face of a 1.25 cm by 18 cm 304 stainless steel workpiece. The disc was driven at 5,500 rpm while the portion of the disc overlaying the beveled edge of the back-up pad contacted the workpiece at a force of 57.8 N, generating a disc wear path of about 140 $cm^2$. Each disc was used to grind a separate workpiece for two minutes each, for a total time of 10 minutes each.

TEST PROCEDURE VI

The abrasive grinding test used a ABB IRB3000, 6-axis industrial robot, to manipulate a metal workpiece against the coated abrasive belt. The abrasive was mounted on a Hammond RBG constant force backstand and supported by a rubber contact wheel. The metal workpieces were weighed before and after each grinding cycle to determine the amount of material removed. The workpiece was fixtured to the robot which manipulated it about the abrasive belt while the backstand provided a constant grinding force for the 25 second duration of the grinding cycle. The robot grinding sequence was repeated until the amount removed in a grinding cycle was less than the test end point listed in the chart below. Test Procedure VI includes two sets of standard conditions, which are set forth below.

| | Std. Conditions 1 | Std. Conditions 2 |
|---|---|---|
| Workpiece | Titanium | 304 Stainless steel |
| Workpiece size | 2.2 × 1.9 × 30.5 cm | 1.9 × 1.9 × 30.5 cm |
| Abrasive belt size | 5.1 cm × 335 cm | 5.1 cm × 335 cm |

-continued

| | Std. Conditions 1 | Std. Conditions 2 |
|---|---|---|
| Contact wheel Hardness | 70 Shore A | 70 Shore A |
| Contact wheel Serration | 0.95 cm Land to 0.95 cm groove | 0.95 cm Land to 0.95 cm groove |
| Contact wheel Diameter | 35.5 cm | 35.5 cm |
| Belt speed | 777 SMPM | 2235 SMPM |
| Force applied | 66.7 N | 66.7 N |
| Test end point | 3.1 grams | 25 grams |

Examples 1–7 and Comparative Examples A and B

The coated abrasive for Examples 1–7 and Comparative Examples A and B were made according to the General Procedure for Making Coated Abrasives, above. The formulations of the grinding aid used in Examples 1–7 are shown in Table I. Comparative Example A was an abrasive article including silicon carbide abrasive particles and did not contain a supersize coat. Comparative Example B was supersized at a coating rate of 193 $g/m^2$ with the conventional $KBF_4$ supersize (29.2% BPAW, 0.35% EMI, 53.3 $KBF_4$, 14.1% water, 0.75% AOT and 2.3% 10).

TABLE 1

| EXAMPLE: | 1 | 2 | 3 | 4 | 5 | 6 | 7 |
|---|---|---|---|---|---|---|---|
| $K_3PO_4$ | 20 | 20 | | 20 | 20 | 20 | |
| CA | 20 | 20 | 40 | 20 | | | 9 |
| NC-6075 | | 22 | | | | | |
| TA | | | | | 23.4 | | |
| OA | | | | | | 14 | |
| SM | | | | | | | 20 |
| Water | 16 | 22 | 16 | 16 | 17.3 | 13.6 | 40.2 |

Examples 1 and 2 and Comparative Examples A and B

Performance of the abrasive articles in Examples 1–2 and Comparative Examples A and B were compared using Test Procedure I, described above. The data is shown in Table 2 below. In the columns labeled "% of Comp. A" and "% of Comp. B," the data shown in parentheses are a comparison with final cut values while the data outside the parentheses are a comparison with total cut values with the abrasive article of Comparative Example A and B, respectively.

TABLE 2

TITANIUM GRINDING RESULTS/GRADE 80 SiC

| | Initial Cut/ 1 min. (g) | Final Cut 1 min. (g) | Total Cut/ 8 min. (g) | % of Comp. A | % of Comp. B |
|---|---|---|---|---|---|
| Comp. B | 1.8 | 0.8 | 10.0 | 151(160) | 100(100) |
| Example 1 | 1.9 | 1.1 | 11.8 | 179(220) | 106(138) |
| Example 2 | 2.05 | 0.8 | 11.2 | 170(160) | 114(100) |
| Comp. A | 1.55 | 0.5 | 6.6 | 100(100) | 86(63) |

Table 2 shows the grinding performance on titanium for the $K_3PO_4$-Citric acid supersize as compared to a supersize containing no grinding aid (Comparative Example A) or a supersize containing a known grinding aid $KBF_4$ (Comparative Example B). In Table 2, both the $K_3PO_4$-citric acid supersizes with or without the NC-6075 binder outperformed both $KBF_4$ supersize and the unsupersized SiC discs by a large margin. From Table 2, the $K_3PO_4$-citric acid supersize ground close to 180% of the control compared to 150% for the $KBF_4$ supersize (Comparative Example B). The final cut of the $K_3PO_4$-citric acid supersize was 220% of Comparative Example A (no supersize) and 138% of Comparative Example B ($KBF_4$ supersize). Thus, $K_3PO_4$-citric acid showed improved grinding results in titanium grinding.

Additionally, the citric acid formulation coated from water forms a fairly continuous film on a size coating of an abrasive article. It was observed that when $K_3PO_4$ was incorporated with the citric acid, the film formed on the peripheral surface of the abrasive article became transparent, smooth, and substantially continuous.

Examples 3–7 and Comparative Example C

In order to show that the current observation was unique to the $K_3PO_4$-citric acid system, more grinding tests were conducted on the rest of the supersize compositions of Examples 3–7 shown in Table 1. Comparative Example C is the same type of abrasive article as Comparative Example A. These results are shown in Table 3.

TABLE 3

TITANIUM GRINDING RESULTS/GRADE 80 SiC

| | Initial Cut/ 1 min. (g) | Final Cut 1 min. (g) | Total Cut/ 8 min. (g) | % of Comp. C |
|---|---|---|---|---|
| Example 3 | 1.1 | 0.4 | 3.7 | 128 |
| Example 4 | 1.2 | 0.6 | 5.5 | 190 |
| Example 5 | 1.3 | 0.8 | 5.8 | 200 |
| Example 6 | 1.3 | 0.3 | 4.0 | 138 |
| Example 7 | 1.0 | 0.3 | 3.0 | 103 |
| Comp. C | 0.9 | 0.4 | 2.9 | 100 |

The $K_3PO_4$-tartaric acid system of Example 5 appeared to grind better than $K_3PO_4$-citric acid of Example 4. Because the cost of citric acid is much lower than that of tartaric acid, it would be more economical to utilize the citric acid system.

Examples 8–10 and Comparative Example D

The grinding performance of the $K_3PO_4$/citric acid supersize described in Example 1 of Table 1 on Grade 36 Regalloy belts (3M 977F, available from 3M, St. Paul, Minn.). Table 4 shows the coating weight of the grinding aid used in Examples 8–10. Comparative Example D was a Grade 36 Regalloy belt without a supersize grinding aid. The performance of these abrasive articles was then evaluated using Test Procedure II, under the following conditions:

Workpiece=2.54 cm Titanium bars

Pressure=111 N constant

Belt speed=811 smpm (surface meters per minute)

Test length=8 min (16×30 sec grind intervals)

The performance results are tabulated in Table 4.

TABLE 4

| Example (Supersize wt.) | Init. Cut (g) | Final Cut (g) | Tot. Cut (g) | % of Comp. D |
|---|---|---|---|---|
| Comp. D (no supersize) | 14.4 | 1.1 | 76.1 | 100 |
| Example 8(59) | 15.4 | 1.1 | 88.9 | 117 |
| Example 9(74) | 15.2 | 2.0 | 89.4 | 117 |
| Example 10(113) | 15.9 | 2.8 | 103.8 | 136 |

As shown in Table 4, higher weight of supersize coatings tended to enhance the grinding performance of the construction. No smearing was noted in this evaluation.

Examples 11–14 and Comparative Example E

The coated abrasive for Examples 11–14 and Comparative Example E were made according to the General Procedure for Making Coated Abrasives, above. These examples compared the abrading characteristics of coated abrasive articles of this invention including an inorganic orthophosphate salt with an organic acid with an optional binder. The formulations for supersize coats for Examples 11–14 are shown in Table 5.

TABLE 5

| Materials: | EXAMPLE 11 | EXAMPLE 12 | EXAMPLE 13 | EXAMPLE 14 |
|---|---|---|---|---|
| $K_3PO_4$ | 20 | 10 | 20 | 20 |
| CA | 19 | 20 | 10 | 7 |
| I33 | 0.3 | 0.25 | 0.22 | 0.2 |
| LA | 0.2 | 0.17 | 0.15 | 0.13 |
| Water | 19 | 16 | 14 | 12 |

The performance of these abrasive articles was then evaluated using Test Procedure I, under the following conditions:

Cut Interval: 4×one-minute cycles/disc

Product: Grade 80 silicon carbide abrasive particles on fiber discs—See General Procedure for Making Coated Abrasive Discs Workpieces: Titanium discs, 30.5 cm in diameter by 0.32 cm thick The performance results are tabulated below in Table 6. TABLE 6.

TABLE 6

| Example (pH) | Init. Cut, (g) | Fin. Cut, (g) | Tot. Cut, (g) | % of Comp. E |
|---|---|---|---|---|
| Comp. E [no supersize] | 1.6 | 0.7 | 3.8 | 100 |
| Example 11(5.5) | 2.3 | 0.9 | 5.7 | 150 |
| Example 12(4.5) | 2.0 | 0.8 | 4.9 | 129 |
| Example 13(7.5) | 1.6 | 0.7 | 4.0 | 105 |
| Example 14(8.0) | 1.8 | 0.8 | 4.9 | 129 |

As shown in Table 6, Example 11 coated with the supersize having pH of about 5.5 demonstrated improved grinding results.

In evaluating these abrasive articles, it is worth noting that there appears to be a strong correlation between uniformity of the supersize coating and abrasive article performance. That is, the abrasive article performed best when the supersize wetted the disk well, as exemplified by Example 11.

Examples 15–16 and Comparative Examples F–H This set of examples compared various coated abrasive constructions. The coated abrasive articles for Examples 15–16 and Comparative Examples F–H were made according to the General Procedure for Forming the Endless-seamless Coated Abrasive Articles, above. Table 7 summarizes the formulation differences between the examples and the comparative examples.

TABLE 7

| Example | MAKE Wt.g/m$^2$ | ABRASIVE PARTICLES Wt. g/m$^2$ (Grade 80) | SIZE Wt. g/m$^2$ | SUPERSIZE Wt. g/m$^2$ |
|---|---|---|---|---|
| Comp. F | 100 | 264 (SiC) | 299 | NONE |

TABLE 7-continued

| Example | MAKE Wt.g/m$^2$ | ABRASIVE PARTICLES Wt. g/m$^2$ (Grade 80) | SIZE Wt. g/m$^2$ | SUPERSIZE Wt. g/m$^2$ |
|---|---|---|---|---|
| Comp. G | 97 | 267 (SiC) | 305 | 132 |
| Example 15 | 103 | 279 (SiC) | 308 | 132 |
| Comp. H | 97 | 390 ($Al^2O_3$) | 332 | 132 |
| Example 16 | 97 | 399 ($Al_2O_3$) | 335 | 132 |

The supersizes for Examples 15 and 16 were the same as for prior Example 1 shown in Table 1. Comparative examples F and G had the same supersize as mentioned in the General Procedure for Preparing an Endless-Seamless Abrasive Articles, above.

These abrasive articles were tested according to Test Procedure III using 2.5×61 cm belts. The results are shown in Table 8, below.

TABLE 8

| Example | Belt Loss Weight(g) | Ave. Cut (g) 2 Min./Ti | Total Cut (g) 3 Min./Ti |
|---|---|---|---|
| Comp. F | 0.52 | 1.2 | 1.6 ± 0.4 |
| Comp. G | 0.63 | 1.4 | — |
| Example 15 | 0.80 | 1.8 | 2.5 ± 0.7 |
| Comp. H | 0.45 | 2.0 | 2.5 ± 0.5 |
| Example 16 | 0.65 | 2.1 | 2.6 ± 0.5 |

The supersize containing citric acid improved the cut over the initial 2 minutes of the life of the belt. While the loss of belt weight may be higher in Examples 15 and 16, it appears that the abrasive articles according to the invention may be making more effective use of the abrasive particles. It was also noted that the spark shower was nearly absent, which may indicate that the abrasive articles in Examples 15 and 16 were cutting at a cooler temperature which, in turn, may decrease the likelihood to burn the workpiece surface. Again, no smearing was noted on the workpiece surface.

Examples 17–18 and Comparative Example I

The coated abrasive for Examples 17–18 and Comparative Example I were made according to the General Procedure for Making Coated Abrasives, above. Coating weights and formulations were:

Make Coat: 170 g/m$^2$ prepared by mixing 69 parts of 70% solids RPI (48 parts resole phenolic resin), 52 parts non-agglomerated calcium carbonate filler (dry weight basis), and enough HP to form a make coating in each case which was 84% solids.

Ceramic Aluminum Oxide; Grade 36: 1,100 g/m$^2$

Size Coat: 740 g/m$^2$ of 32% RP1, 50.2% CRY, 1.5% IO, and 16.3% HP.

Supersize Coat: 410 g/m$^2$ of 29.2% BPAW, 0.35% EMI, 53.3% KBF4, 14.1% water, 0.75% AOT, and 2.3% IO for Comparative Example I. Supersize formulations for Examples 17 and 18 are in Table 9 below.

TABLE 9

| Materials | Example 17 | Example 18 |
|---|---|---|
| $H_2O$ | 40.95 | 14.81 |
| CA | 27.5 | 10.40 |
| $K_3PO_4$ | 27.5 | — |

TABLE 9-continued

| Materials | Example 17 | Example 18 |
|---|---|---|
| $KBF_4$ | 105.0 | 40.00 |
| IO | 2.0 | 0.50 |
| KOH (89% wt.) | — | 8.25 |
| $H_3PO_4$(85% wt.) | — | 5.65 |

Performance of the abrasive articles in Examples 17–18 and Comparative Example I were compared using Test Procedure IV on stainless steel, described above. Dispersions of $KBF_4$ in these phosphate salt mixtures readily form, indicting that the phosphate/citric acid mixture functioned as a binder-like system for $KBF_4$. The data is shown in Table 10, below, where the grams of material removed are shown as well as the % of Comparative Example I (in parentheses).

TABLE 10

| Example | Initial Cut (g) | Final Cut (g) | Total Cut (g) |
|---|---|---|---|
| Comp. I | 88 (100) | 35 (100) | 220 (100) |
| Example 17 | 82 (93) | 42 (120) | 228 (104) |
| Example 18 | 83 (94) | 45 (129) | 234 (107) |

A grinding aid in the supersize formulations in Examples 17 and 18 contained approximately 10% more $KBF_4$ (dispersed in a mixture of citric acid/potassium citrate) than the supersize formulation of Comparative Example I. It is noteworthy that the abrasive articles of Examples 17 and 18 performed better than the Comparative Example I in the final four minutes of testing, indicating enhanced effectiveness and durability of a grinding aid containing an organic acid mixture and a known secondary grinding aid (namely, $KBF_4$). Overall, the abrasive articles of Examples 17 and 18 performed slightly better than Comparative Example I.

The following types of abrasive particles were used in Examples 19–25 and Comp. Examples J–T.

Abrasive Particles

321: Cubitron 321 grain (commercially available from 3M, St. Paul, Minn.).

321-s: 321-s was made by separating the blockier abrasive particle from the sharper particles in a sample of 321 using a Jeffrey Vibrating Shape Sorting Table, Type 2DTH (available from Jeffrey Mfg. Co., Ltd., Johannesburg, South Africa), using the following settings: feed angle of 5.23°, sorting angle of 12.07°, vibratory feed rate of 77.4 g/min, table vibration amplitude of 0.5 amps. The sharp abrasive particles were collected as 321-s.

321-1: 321-1 was prepared as described in U.S. Pat. No. 5,776,214 (Wood), Example 7, at column 24, line 64 to column 25, line 19.

321-b: 321-b was made by separating the blockier abrasive particles from the sharper abrasive particles in a sample of 321 using a Jeffrey Vibrating Shape Sorting Table, Type 2DTH (available from Jeffrey Mfg. Co., Ltd., Johannesburg, South Africa), using the following settings: feed angle of 5.23°, sorting angle of 12.07°, vibratory feed rate of 77.4 g/min, table vibration amplitude of 0.5 amps. The blockier abrasive particles were collected as 321-b.

Examples—Comparative Examples J, K, & L and Examples 19–21

Six lots of fiber discs were made by General Procedure 3 for Making Coated Abrasive (Discs) using 3 different types of grade 36 Cubitron 321 grain and 2 different supersize formulations. Conventional $KBF_4$ supersize (29.2% BPAW, 0.35% EMI, 53.3 $KBF_4$, 14.1% water, 0.75% AOT and 2.3% 10) was applied to it Comparative Examples J, K, and L at a coating weight of about 389 g/m$^2$. Supersize formulation 1 was applied to Examples 19, 20, and 21 at a coating weight of about 389 g/m$^2$. Supersize formulation 1 is shown in Table 11. The fiber disc constructions are summarized in Table 12.

TABLE 11

Supersize Formulation 1

| Component | % weight |
|---|---|
| $H_2O$ | 23.09 |
| CA | 9.46 |
| KOH (86.9%) | 9.54 |
| $H_3PO_4$ (85%) | 5.68 |
| $KBF_4$ | 48.34 |
| IO | 1.21 |
| RP1 | 2.68 |

TABLE 12

| Lot | Abrasive Particles | Bulk Density[1] (g/cm$^3$) | Supersize |
|---|---|---|---|
| Comp. J | 321 | 1.86 | Conventional $KBF_4$ |
| Ex. 19 | 321 | 1.86 | Formulation 1 |
| Comp. K | 321-s | 1.80 | Conventional $KBF_4$ |
| Ex. 20 | 321-s | 1.80 | Formulation 1 |
| Comp. L | 321-1 | 1.82 | Conventional $KBF_4$ |
| Ex. 21 | 321-1 | 1.82 | Formulation 1 |

[1]Measured using ANSI Standard B74.4-1992

Performance of the abrasive articles in Examples 19–21 and Comparative Examples J, K, and L were compared using Test Procedure V. The data is shown in Table 13.

TABLE 13

| Lot | Initial Cut g (% of Comp. J) | Final Cut g (% of Comp. J) | Total Cut g (% of Comp. J) |
|---|---|---|---|
| Comp. J | 89.0 (100) | 31.5 (100) | 248.5 (100) |
| Example 19 | 99.0 (111.2) | 36.3 (115.3) | 292.3 (117.6) |
| Comp. K | 93.7 (105.2) | 35.0 (111.1) | 278.0 (111.9) |
| Example 20 | 112.0 (125.8) | 41.8 (132.5) | 347.3 (139.8) |
| Comp. L | 123.8 (139.1) | 36.8 (116.8) | 342.6 (137.9) |
| Example 21 | 165.6 (186.0) | 58.5 (185.7) | 486.3 (195.7) |

From the data in Table 13, it can be seen that the lower bulk density grains of 321 -s and 321-1 gave improvement in total cut of about 40% (Example 20) and 96% (Example 21) over the higher bulk density 321.

Examples—Comparative Examples M-U and Examples 22–25

Twelve lots (Comp. Examples M-T and Examples 22-25) of coated abrasives were made according to General Procedure 4 for Making Coated Abrasives Articles using 4 types of grade 36 Cubitron 321 grain with 2 different supersizes as well as examples without supersize. Conventional $KBF_4$ supersize ( 29.2% BPAW, 0.35% EMI, 53.3 $KBF_4$, 14.1% water, 0.75% AOT and 2.3% 10) was applied to Comparative Examples N, P, R, and T. Supersize formulation 2 was applied to Examples 22–25. Supersize formulation 2 is shown in Table 14. The abrasive constructions are summarized in Table 15.

TABLE 14

Supersize Formulation 2

| Component | % weight |
|---|---|
| $H_2O$ | 26.16 |
| $K_3Ct$-$H_2O$ | 16.0 |
| $H_3PO_4$ (85%) | 5.69 |
| $KBF_4$ | 48.43 |
| IO | 1.22 |
| RP1 | 2.50 |

TABLE 15

| Lot | Abrasive Particles | Bulk Density (g/cm$^3$) | Supersize |
|---|---|---|---|
| Comp. M | 321 | 1.86 | NONE |
| Comp. N | 321 | 1.86 | Conventional $KBF_4$ |
| Ex. 22 | 321 | 1.86 | Formulation 2 |
| Comp. O | 321-b | 1.93 | NONE |
| Comp. P | 321-b | 1.93 | Conventional $KBF_4$ |
| Ex. 23 | 321-b | 1.93 | Formulation 2 |
| Comp. Q | 321-s | 1.81 | NONE |
| Comp. R | 321-s | 1.81 | Conventional $KBF_4$ |
| Ex. 24 | 321-s | 1.81 | Formulation 2 |
| Comp. S | 321-1 | 1.74 | NONE |
| Comp. T | 321-1 | 1.74 | Conventional $KBF_4$ |
| Ex. 25 | 321-1 | 1.74 | Formulation 2 |

Comp. U: Grade 36 Regalloy belts, 3M 977F, commercially available from 3M, St. Paul, MN.

Performance of the abrasive articles in Examples 22–25 and Comparative Examples M–U on 304 stainless steel at 52.9–66.6 N load were compared using Test Procedure VI (Std. Conditions 2). The data is set forth in Table 16.

TABLE 16

| EXAMPLE | Initial (g) | # cycles | Total (g) | Total (% of Comp. U) |
|---|---|---|---|---|
| Comp. M | 43.5 | 20 | 457 | 38 |
| Comp. N | 47.2 | 31 | 1015 | 85 |
| Example 22 | 46.3 | 45 | 1405 | 118 |
| Comp. O | 40.8 | 16 | 357 | 30 |
| Comp. P | 43.3 | 35 | 1079 | 90 |
| Example 23 | 46.8 | 43 | 1351 | 113 |
| Comp. Q | 45.7 | 18 | 441 | 37 |
| Comp. R | 47.4 | 36 | 1154 | 97 |
| Example 24 | 45.3 | 49 | 1531 | 128 |
| Comp. S | 52.3 | 25 | 644 | 54 |
| Comp. T | 49.6 | 39 | 1242 | 104 |
| Example 25 | 53.4 | 50 | 1652 | 138 |
| Comp. U | 48.4 | 37 | 1192 | 100 |

Performance of the abrasive articles in Examples 22–25 and Comparative Examples M–U on titanium at 52.9–66.6 N load were compared using Test Procedure VI (Std. Conditions 1). The data is shown in Table 17 below.

TABLE 17

| Example | Initial (g) | # cycles | Total (g) | Total (%) |
|---|---|---|---|---|
| Comp. M | 7.0 | 9 | 38.1 | 98 |
| Comp. N | 7.1 | 11 | 47.7 | 123 |
| Example 22 | 7.2 | 12 | 52.0 | 134 |

TABLE 17-continued

| Example | Initial (g) | # cycles | Total (g) | Total (%) |
|---|---|---|---|---|
| Comp. O | 6.8 | 8 | 33.5 | 87 |
| Comp. P | 7.1 | 10 | 42.8 | 111 |
| Example 23 | 6.9 | 12 | 49.9 | 129 |
| Comp. Q | 7.6 | 10 | 44.2 | 114 |
| Comp. R | 7.3 | 12 | 51.6 | 133 |
| Example 24 | 7 | 13 | 57.3 | 149 |
| Comp. S | 7.9 | 10 | 45.9 | 119 |
| Comp. T | 7.2 | 10 | 42.1 | 109 |
| Example 25 | 7.3 | 12 | 51.0 | 132 |
| Comp. U | 7.2 | 9 | 38.7 | 100 |

The complete disclosures of all patents, patent applications, and publications are incorporated herein by reference as if individually incorporated. Various modifications and alterations of this invention will become apparent to those skilled in the art from the foregoing description without departing from the scope and the spirit of this invention, and it should be understood that this invention is not to be unduly limited to the illustrative embodiments set forth herein.

What is claimed is:

1. An abrasive article comprising:

a backing having a first major surface and a second major surface;

a plurality of abrasive particles;

a make coat formed from a first binder precursor, wherein the make coat bonds the plurality of abrasive particles to the first major surface of the backing; and a peripheral coating layer comprising a grinding aid formed from a mixture comprising an acid and at least one of:

(i) an inorganic metal phosphate salt selected from the group consisting of alkali metal phosphate salts and alkaline earth metal phosphate salts; or (ii) an inorganic metal sulfate salt selected from the group consisting of alkali metal sulfate salts, alkaline earth metal sulfate salts and transition metal sulfate salts.

2. The abrasive article of claim 1, wherein the acid is selected such that the mixture forms a film.

3. The abrasive article of claim 1, wherein the inorganic metal phosphate salt is selected from the group consisting of tripotassium orthophosphate, trisodium orthophosphate, tricalcium orthophosphate, sodium pyrophosphate, potassium pyrophosphate, and mixtures thereof.

4. The abrasive article of claim 1, wherein the inorganic metal sulfate salt is selected from the group consisting of sodium sulfate, potassium sulfate, cesium sulfate, copper(II) sulfate, iron(II) sulfate, manganese(II) sulfate, cobalt(II) sulfate and mixtures thereof.

5. The abrasive article of claim 1, wherein the acid is an organic acid.

6. The abrasive article of claim 5, wherein the organic acid is selected from the group consisting of citric acid, lactic acid, oxalic acid, tartaric acid, and mixtures thereof.

7. The abrasive article of claim 1, wherein the first binder precursor is selected from the group consisting of a phenolic resin, an aminoplast resin having pendant α,β-unsaturated carbonyl groups, a urethane resin, an epoxy resin, an ethylenically unsaturated resin, an acrylated isocyanurate resin, a urea-formaldehyde resin, an isocyanurate resin, an acrylated urethane resin, an acrylated epoxy resin, a bismaleimide resin, a fluorene modified epoxy resin, and mixtures thereof.

8. The abrasive article of claim 1, wherein the mixture has a pH of about 8.5 to about 5.0.

9. The abrasive article of claim 1 further comprising a size coat formed from a second binder precursor, wherein the peripheral coating layer is on the size coat.

10. The abrasive article of claim 9, wherein the peripheral coating layer further comprises a binder formed from a third binder precursor.

11. The abrasive article of claim 10, wherein the second binder precursor and the third binder precursor are each selected from the group consisting of a phenolic resin, an aminoplast resin having pendant α,β-unsaturated carbonyl groups, a urethane resin, an epoxy resin, an ethylenically unsaturated resin, an acrylated isocyanurate resin, a urea-formaldehyde resin, an isocyanurate resin, an acrylated urethane resin, an acrylated epoxy resin, a bismaleimide resin, a fluorene modified epoxy resin, and mixtures thereof.

12. The abrasive article of claim 1, wherein the mixture further comprises an optional additive selected from the group consisting of a secondary grinding aid, a fibrous material, an antistatic agent, a lubricant, a wetting agent, a surfactant, a pigment, a dye, a coupling agent, a plasticizer, a release agent, a suspending agent, a rheology modifier, a curing agent, and mixtures thereof.

13. The abrasive article of claim 1, wherein the mixture further comprises a secondary grinding aid selected from the group consisting of sodium chloride, potassium aluminum hexafluoride, sodium aluminum hexafluoride, ammonium aluminum hexafluoride, potassium tetrafluoroborate, sodium tetrafluoroborate, silicon fluorides, potassium chloride, magnesium chloride, and mixtures thereof.

14. The abrasive article of claim 1, wherein the abrasive particles are sharp abrasive particles.

15. The abrasive article of claim 14, wherein the sharp abrasive particles have a bulk density for grade 36 of less than about 1.85 grams/$cm^3$.

16. The abrasive article of claim 14, wherein the sharp abrasive particles have a bulk density for grade 36 of less than about 1.81 grams/$cm^3$.

17. The abrasive article of claim 14, wherein the sharp abrasive particles have a bulk density for grade 50 of less than about 1.79 grams/$cm^3$.

18. The abrasive article of claim 14, wherein the sharp abrasive particles have an aspect ratio of about 1.5.

19. The abrasive article of claim 14, wherein the sharp abrasive particles have a mean volume particle ratio ranging from about 0.30 to 0.80.

20. The abrasive article of claim 14, wherein the abrasive particles are alpha alumina.

21. An abrasive article comprising:

a backing having a first major surface and a second major surface;

a plurality of abrasive particles;

a make coat formed from a first binder precursor, wherein the make coat bonds the plurality of abrasive particles to the first major surface of the backing; and a peripheral coating layer comprising a grinding aid formed from a mixture comprising an acid component, and a compound containing an alkali metal or an alkaline earth metal, with the provisos that:

(i) when the acid component consists essentially of an organic acid, the compound containing an alkali metal or an alkaline earth metal is a phosphate salt or a sulfate salt; and (ii) when the acid component consists essentially of a combination of an organic acid and a mineral acid, the compound containing an alkali metal or an alkaline earth metal is a base thereof.

22. The abrasive article of claim 21, wherein the organic acid is selected from the group consisting of citric acid, lactic acid, oxalic acid, tartaric acid, and mixtures thereof.

23. The abrasive article of claim 21, wherein the mineral acid is selected from the group consisting of hydrochloric acid, nitric acid, sulfuric acid, phosphoric acid, tetrafluoroboric acid, and mixtures thereof.

24. The abrasive article of claim 21, wherein the base of an alkali metal or an alkaline earth metal is selected from the group consisting of sodium hydroxide, potassium hydroxide, lithium hydroxide, magnesium hydroxide, calcium hydroxide, barium hydroxide, and mixtures thereof.

25. The abrasive article of claim 21, wherein the phosphate salt is selected from the group consisting of tripotassium orthophosphate, trisodium orthophosphate, tricalcium orthophosphate, sodium pyrophosphate, potassium pyrophosphate, and mixtures thereof.

26. The abrasive article of claim 21, wherein the sulfate salt is selected from the group consisting of sodium sulfate, potassium sulfate, cesium sulfate and mixtures thereof.

27. The abrasive article of claim 21, further comprising a size coat formed from a second binder precursor, wherein the peripheral coating layer is on the size coat.

28. The abrasive article of claim 27, wherein the peripheral coating layer further comprises a binder formed from a third binder precursor.

29. The abrasive article of claim 28, wherein at least one of the make coat, the size coat, or the peripheral coating layer further comprises an optional additive selected from the group consisting of a secondary grinding aid, a fibrous material, an antistatic agent, a lubricant, a wetting agent, a surfactant, a pigment, a dye, a coupling agent, a plasticizer, a release agent, a suspending agent, a rheology modifier, a curing agent, and mixtures thereof.

30. The abrasive article of claim 21, wherein the mixture further comprises a secondary grinding aid selected from the group consisting of sodium chloride, potassium aluminum hexafluoride, sodium aluminum hexafluoride, ammonium aluminum hexafluoride, potassium tetrafluoroborate, sodium tetrafluoroborate, silicon fluorides, potassium chloride, magnesium chloride, and mixtures thereof.

31. The abrasive article of claim 21, wherein the abrasive particles are sharp abrasive particles.

32. An abrasive article comprising:

at least one binder formed from a composition comprising a binder precursor and a grinding aid formed from a mixture comprising an acid and at least one of:

(i) an inorganic metal phosphate salt selected from the group consisting of alkali metal phosphate salts and alkaline earth metal phosphate salts; or (ii) an inorganic metal sulfate salt selected from the group consisting of alkali metal sulfate salts, alkaline earth metal sulfate salts, and transition metal sulfate salts; and a plurality of abrasive particles dispersed within the at least one binder to form a plurality of shaped composites having a peripheral surface that contacts a workpiece surface.

33. The abrasive article of claim 32, wherein the inorganic metal phosphate salt is selected from the group consisting of tripotassium orthophosphate, trisodium orthophosphate, tricalcium orthophosphate, sodium pyrophosphate, potassium pyrophosphate, and mixtures thereof.

34. The abrasive article of claim 32, wherein the inorganic metal sulfate salt is selected from the group consisting of sodium sulfate, potassium sulfate, cesium sulfate, copper(II) sulfate, iron(II) sulfate, manganese(II) sulfate, cobalt(II) sulfate and mixtures thereof.

35. The abrasive article of claim 32, wherein the acid is an organic acid selected from the group consisting of citric acid, lactic acid, oxalic acid, tartaric acid, and mixtures thereof.

36. The abrasive article of claim 32, wherein the binder precursor is selected from the group consisting of a phenolic resin, an aminoplast resin having pendant α,β-unsaturated carbonyl groups, a urethane resin, an epoxy resin, an ethylenically unsaturated resin, an acrylated isocyanurate resin, a urea-formaldehyde resin, an isocyanurate resin, an acrylated urethane resin, an acrylated epoxy resin, a bismaleimide resin, a fluorene modified epoxy resin, and mixtures thereof.

37. The abrasive article of claim 32, wherein the at least one binder further comprises an optional additive selected from the group consisting of a secondary grinding aid, a fibrous material, an antistatic agent, a lubricant, a wetting agent, a surfactant, a pigment, a dye, a coupling agent, a plasticizer, a release agent, a suspending agent, a rheology modifier, a curing agent, and mixtures thereof.

38. The abrasive article of claim 32, wherein the abrasive particles are sharp abrasive particles.

39. An abrasive article comprising:

at least one binder formed from a composition comprising a binder precursor and a grinding aid formed from a mixture comprising an acid component and a compound containing an alkali metal or an alkaline earth metal, with the provisos that:

(i) when the acid component consists essentially of an organic acid, the compound containing an alkali metal or an alkaline earth metal is a phosphate salt or a sulfate salt; and (ii) when the acid component consists essentially of a combination of an organic acid and a mineral acid, the compound containing an alkali metal or an alkaline earth metal is a base thereof; and a plurality of abrasive particles secured within the at least one binder to form a shaped mass having a peripheral surface that contacts a workpiece surface.

40. The abrasive article of claim 39, wherein the shaped mass is a grinding wheel.

41. The abrasive article of claim 39 further comprising a pressure sensitive adhesive on a surface opposite the peripheral surface.

42. The abrasive article of claim 39, wherein the phosphate salt is selected from the group consisting of tripotassium orthophosphate, trisodium orthophosphate, tricalcium orthophosphate, sodium pyrophosphate, potassium pyrophosphate, and mixtures thereof.

43. The abrasive article of claim 39, wherein the sulfate salt is selected from the group consisting of sodium sulfate, potassium sulfate, cesium sulfate and mixtures thereof.

44. The abrasive article of claim 39, wherein the organic acid is selected from the group consisting of citric acid, lactic acid, oxalic acid, tartaric acid, and mixtures thereof.

45. The abrasive article of claim 39, wherein the binder precursor is selected from the group consisting of a phenolic resin, an aminoplast resin having pendant α,β-unsaturated carbonyl groups, a urethane resin, an epoxy resin, an ethylenically unsaturated resin, an acrylated isocyanurate resin, a urea-formaldehyde resin, an isocyanurate resin, an acrylated urethane resin, an acrylated epoxy resin, a bismaleimide resin, a fluorene modified epoxy resin, and mixtures thereof.

46. The abrasive article of claim 39, wherein the abrasive particles are sharp abrasive particles.

47. The abrasive article of claim 46, wherein the sharp abrasive particles have a bulk density for grade 36 of less than about 1.85 grams/$cm^3$.

48. The abrasive article of claim 46, wherein the sharp abrasive particles have a bulk density for grade 36 of less than about 1.81 grams/$cm^3$.

49. The abrasive article of claim 46, wherein the sharp abrasive particles have a bulk density for grade 50 of less than about 1.79 grams/$cm^3$.

50. The abrasive article of claim 46, wherein the sharp abrasive particles have an aspect ratio of about 1.5.

51. The abrasive article of claim 46, wherein the sharp abrasive particles have a mean volume particle ratio ranging from about 0.30 to 0.80.

52. The abrasive article of claim 46, wherein the abrasive particles are alpha alumina.

53. A method for making a coated abrasive article, comprising the steps of:

applying a first binder precursor to a substrate;

at least partially embedding a plurality of abrasive particles in the first binder precursor;

applying a second binder precursor over the first binder precursor and the plurality of abrasive particles;

applying a peripheral coating mixture on the second binder precursor, wherein the peripheral coating mixture comprises an acid and at least one of:

(i) an inorganic metal phosphate salt selected from the group consisting of alkali metal phosphate salts and alkaline earth metal phosphate salts; or (ii) an inorganic metal sulfate salt selected from the group consisting of alkali metal sulfate salts, alkaline earth metal sulfate salts, and transition metal sulfate salts; and at least partially curing the first binder precursor and the second binder precursor.

54. The method of claim 53, wherein the peripheral coating mixture forms a film.

55. The method of claim 53, wherein the inorganic metal phosphate salt is selected from the group consisting of tripotassium orthophosphate, trisodium orthophosphate, tricalcium orthophosphate, sodium pyrophosphate, potassium pyrophosphate, and mixtures thereof.

56. The method of claim 53, wherein the inorganic metal sulfate salt is selected from the group consisting of sodium sulfate, potassium sulfate, cesium sulfate, copper(II) sulfate, iron(II) sulfate, manganese(II) sulfate, cobalt(l) sulfate and mixtures thereof.

57. The method of claim 53, wherein the acid is an organic acid selected from the group consisting of citric acid, lactic acid, oxalic acid, tartaric acid, and mixtures thereof.

58. The method of claim 53, wherein the first binder precursor and the second binder precursor are each selected from the group consisting of a phenolic resin, an aminoplast resin having pendant $\alpha,\beta$-unsaturated carbonyl groups, a urethane resin, an epoxy resin, an ethylenically unsaturated resin, an acrylated isocyanurate resin, a urea-formaldehyde resin, an isocyanurate resin, an acrylated urethane resin, an acrylated epoxy resin, a bismaleimide resin, a fluorene modified epoxy resin, and mixtures thereof.

59. The method of claim 53, wherein the peripheral coating mixture further comprises a third binder precursor.

60. The method of claim 53, wherein the abrasive particles are sharp abrasive particles.

61. A method of using an abrasive article to grind a workpiece surface comprising the steps of:

frictionally engaging an abrasive article with an outer surface of a workpiece, wherein the abrasive article comprises:

a backing having a first major surface and a second major surface;

a plurality of abrasive particles;

a make coat formed from a first binder precursor, wherein the make coat bonds the plurality of abrasive particles to the first major surface of the backing;

a size coat formed from a second binder precursor, wherein the size coat is on a surface of the plurality of abrasive particles and the make coat; and a peripheral coating layer on the size coat comprising a grinding aid formed from a mixture comprising an acid and at least one of:

(i) an inorganic metal phosphate salt selected from the group consisting of alkali metal phosphate salts and alkaline earth metal phosphate salts; or (ii) an inorganic metal sulfate salt selected from the group consisting of alkali metal sulfate salts, alkaline earth metal sulfate salts, and transition metal sulfate salts;

wherein the peripheral coating layer on the size coat is frictionally engaged with the surface of the workpiece; and moving the abrasive article and the workpiece relative to each other such that the surface of the workpiece is reduced.

62. The method of claim 61, wherein the workpiece is a metal selected from the group consisting of titanium, a titanium alloy and stainless steel.

63. The method of claim 61, wherein the abrasive particles are sharp abrasive particles.

64. An abrasive article comprising:

a backing having a first major surface and a second major surface;

a plurality of abrasive particles;

a make coat formed from a first binder precursor, wherein the make coat bonds the plurality of abrasive particles to the first major surface of the backing; and a peripheral coating layer comprising a grinding aid formed from a mixture comprising (a) a mineral acid, a salt of a mineral acid or a mixture thereof and (b) a salt of an organic acid.

65. The abrasive article of claim 64, wherein the mineral acid is selected from the group consisting of sulfuric acid, nitric acid, hydrochloric acid, phosphoric acid, and mixtures thereof.

66. The abrasive article of claim 64, wherein the salt of a mineral acid is an alkali metal salt or an alkaline earth metal salt.

67. The abrasive article of claim 64, wherein the salt of an organic acid is formed from an organic acid selected from the group consisting of citric acid, lactic acid, oxalic acid, tartaric acid, and mixtures thereof.

68. The abrasive article of claim 64, wherein the salt of an organic acid is an alkali metal or alkaline earth metal salt.

69. The abrasive article of claim 64, wherein the mineral acid is phosphoric acid and the salt of an organic acid is tripotassium citrate.

70. The abrasive article of claim 64, further comprising a size coat formed from a second binder precursor, wherein the peripheral coating layer is on the size coat.

71. The abrasive article of claim 70, wherein the peripheral coating layer further comprises a binder formed from a third binder precursor.

72. The abrasive article of claim 71, wherein the second binder precursor and the third binder precursor are each selected from the group consisting of a phenolic resin, an aminoplast resin having pendant α,β-unsaturated carbonyl groups, a urethane resin, an epoxy resin, an ethylenically unsaturated resin, an acrylated isocyanurate resin, a urea-formaldehyde resin, an isocyanurate resin, an acrylated urethane resin, an acrylated epoxy resin, a bismaleimide resin, a fluorene modified epoxy resin, and mixtures thereof.

73. The abrasive article of claim 64, wherein the mixture further comprises a secondary grinding aid selected from the group consisting of sodium chloride, potassium aluminum hexafluoride, sodium aluminum hexafluoride, ammonium aluminum hexafluoride, potassium tetrafluoroborate, sodium tetrafluoroborate, silicon fluorides, potassium chloride, magnesium chloride, and mixtures thereof.

74. The abrasive article of claim 64, wherein the abrasive particles are sharp abrasive particles.

* * * * *